US005509274A

United States Patent [19]

Lackstrom

[11] Patent Number: 5,509,274

[45] Date of Patent: Apr. 23, 1996

[54] HIGH EFFICIENCY HEAT PUMP SYSTEM

[75] Inventor: David Lackstrom, Cape Canaveral, Fla.

[73] Assignee: Applied Power Technologies Incorporated, Cape Canaveral, Fla.

[21] Appl. No.: 234,007

[22] Filed: Apr. 26, 1994

Related U.S. Application Data

[63] Continuation-in-part of Ser. No. 959,859, Oct. 13, 1992, Pat. No. 5,313,874, which is a continuation-in-part of Ser. No. 821,391, Jan. 16, 1992, Pat. No. 5,205,133.

[51] Int. Cl.[6] ..... F15B 13/00

[52] U.S. Cl. ..... 62/238.4; 237/2 B; 91/459

[58] Field of Search ..... 62/238.4, 238.6, 62/467, 501; 237/2 B, 12.1, 13, 1 R; 417/403, 401, 399, 379; 92/98 D; 137/625.46, 596.17, 596.18; 91/459

[56] References Cited

U.S. PATENT DOCUMENTS 5,129,236 7/1992 Solomon ..... 62/324.1

*Primary Examiner*—Thomas N. Moulis

*Attorney, Agent, or Firm*—Ralph E. Jocke

[57] ABSTRACT

A high efficiency heat transfer system includes a power circuit (350) and heat pump circuit (352). Each circuit having a working fluid flowing therein. In the power circuit, a heater (354) vaporizes the working fluid which is periodically delivered and exhausted through a valve assembly (358) to a power unit (362). The power unit is also a compressor for the working fluid in the heat pump circuit. Fluid exhausted from the driven section of the power unit is passed to a four-way valve (406) which selectively delivers the working fluid to an interior coil (416) or an exterior coil (408) to heat or cool an area. In extremely cold ambient temperatures, the area is heated directly from the power circuit using a by-pass exchanger (428).

7 Claims, 21 Drawing Sheets

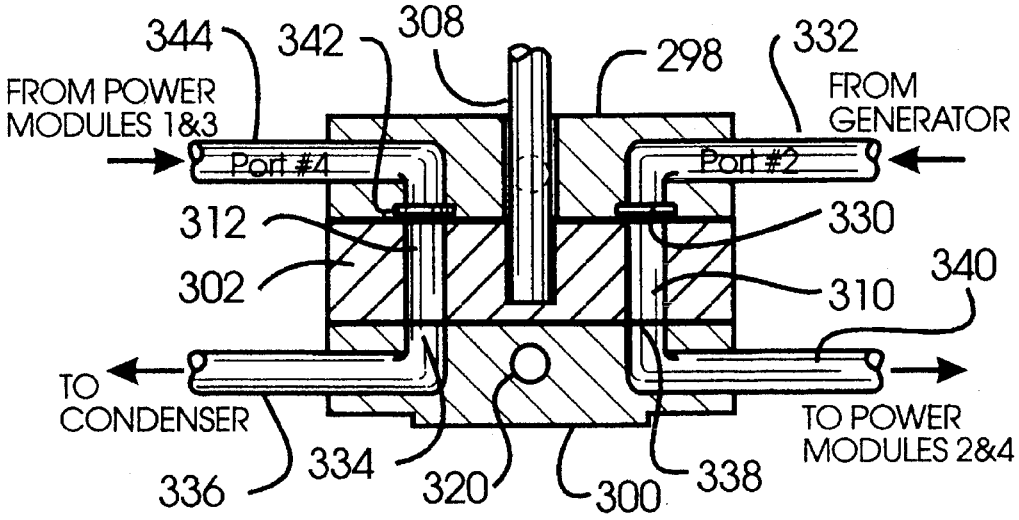
FIG. 16
FIG. 15
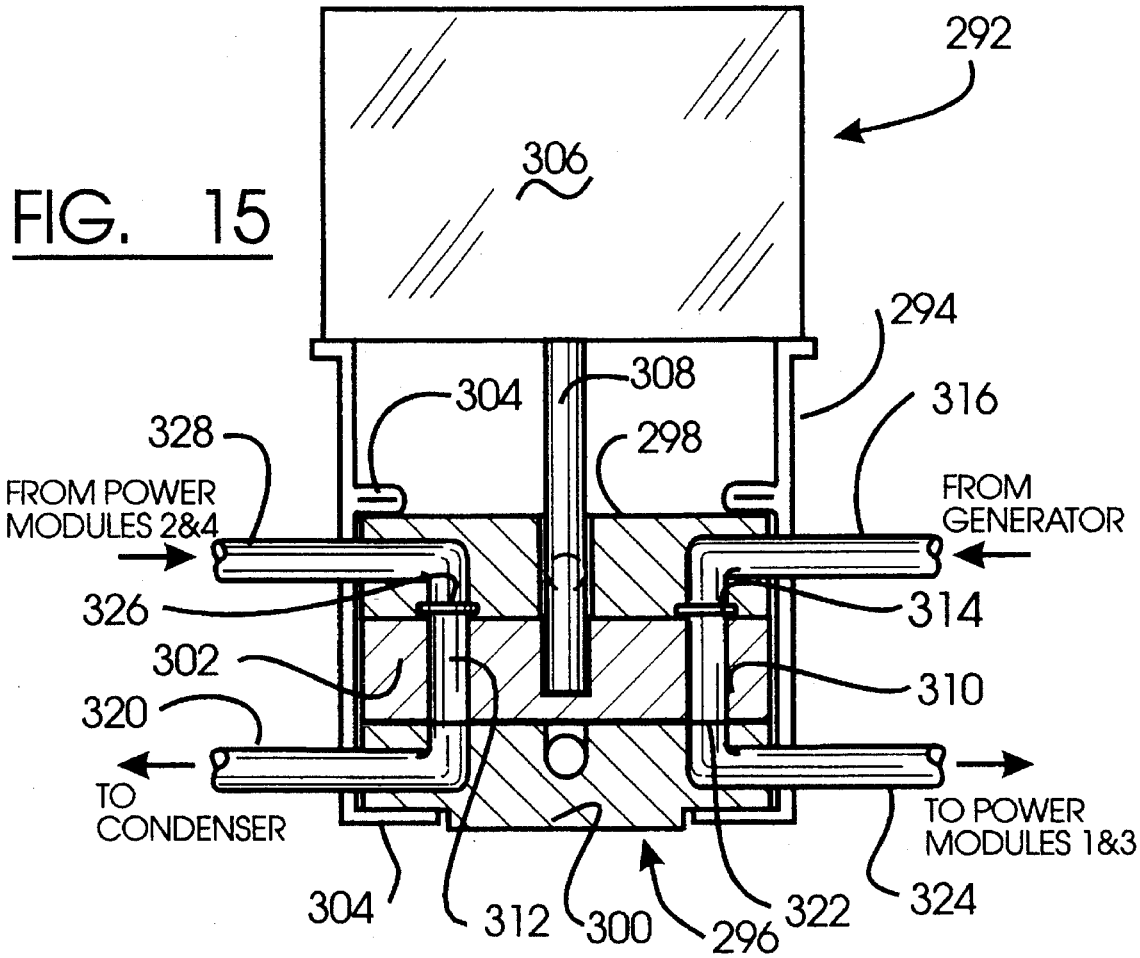

HIGH EFFICIENCY HEAT PUMP SYSTEM

CROSS REFERENCE TO RELATED APPLICATION

This application is a continuation-in-part application of application Ser. No. 07,959,859 filed Oct. 13, 1992, now U.S. Pat. No. 5,313,874, which is a continuation-in-part of application Ser. No. 07/821,391 filed Jan. 16, 1992, now U.S. Pat. No. 5,205,133.

TECHNICAL FIELD

This invention relates to heat transfer systems. Particularly this invention relates to a high efficiency heating and cooling system that is powered by natural gas.

BACKGROUND ART

Heaters for heating water in swimming pools are well known in the prior art. The majority of pool heaters presently in use are gas fired. In such devices, the hot products of combustion are passed through a heat exchanger. Water from the pool is also passed through the heat exchanger and absorbs heat from the products of combustion. While such gas fired units are reliable, they are inefficient. The best theoretical coefficient of performance for such a system is 1:1. Of course the coefficient of performance will always be somewhat less due to losses. This makes a conventional gas fired pool heater expensive to operate.

Other types of pool heaters known in the prior art are electrically powered heat pumps. Such systems use a working fluid such as Freon 22 or other refrigerant, to absorb heat from the atmosphere in an evaporator, resulting in vaporization of the working fluid. The working fluid is then compressed in a compressor and passed to a heat exchanger or condenser that is in heat transfer relation with the pool water. In the heat exchanger the working fluid delivers heat to the pool water and is condensed to a liquid. Thereafter the liquid working fluid flows through an expansion device and returns to the evaporator to complete the cycle. The working fluid continuously flows in the heat pump system to deliver heat from the atmosphere to the pool water.

Because a heat pump system uses heat available from the atmosphere to heat the pool water, such systems may have coefficients of performance in the range of 4:1. However electric heat pump systems may be more expensive to operate than gas fired systems because electricity generally costs more than natural gas. Electric heat pump systems also have a disadvantage in that when the ambient temperature is low, the efficiency of the heat pump system falls. As a result, it is usually necessary to have a supplemental heating system such as a gas fired heater or an electrical resistance heater. Electric heat pump systems also characteristically require more maintenance than gas fired systems which adds to their overall cost.

The need to have a supplemental heating system with a heat pump system increases when the pool is heated in combination with a "hot tub" or spa. People enjoy using their spas year round. In colder climates during the winter a heat pump system alone will not satisfactorily heat the spa water.

Electric heat pump systems are also well known for use in other applications in the prior art. Such systems suffer from deficiencies which are similar to those of pool heating systems. The cost of operation is high, both in terms of electrical energy cost as well as the equipment cost. The equipment has a relatively short useful life. In addition, when the ambient temperature is low, the efficiency falls and a supplemental heat source must be provided.

Thus, there exists a need for a heat pump system that is less expensive to operate than those known in the prior art, has higher efficiency, is more reliable and can be used in colder weather.

DISCLOSURE OF INVENTION

It is an object of the present invention to provide a heat pump system that has higher heating efficiency.

It is a further object of the present invention to provide a heat pump system that is lower in cost to operate.

It is a further object of the present invention to provide a heat pump system that is reliable.

It is a further object of the present invention to provide a heat pump system that can be economically operated in low ambient temperatures.

It is a further object of the present invention to provide a heat pump system that is fired by natural gas.

It is a further object of the present invention to provide a heat pump system that has a long life and requires little maintenance.

It is a further object of the present invention to provide a heat pump system that does not require a separate supplemental heating system for operation in cold temperatures.

It is a further object of the present invention to provide a power unit that effectively compresses refrigerant in a heat transfer system.

It is a further object of the present invention to provide a power unit that is powered by refrigerant material or other gaseous working fluid.

It is a further object of the invention to provide a power unit that has high energy efficiency.

It is a further object of the present invention to provide a power unit that may be readily used in heat transfer systems of various capacities.

It is a further object of the present invention to provide a power unit that can readily change its output in response to changes in heating load.

It is a further object of the present invention to provide a power unit that minimizes vibration.

It is a further object of the present invention to provide a condensate pump that is reliable and efficient.

It is a further object of the present invention that applies uniform pressure to condensed refrigerant and avoids flashing of the condensed refrigerant to a vapor.

Further objects of the present invention will be made apparent in the following Best Modes For Carrying Out Invention and the appended claims.

The foregoing objects are accomplished in the preferred embodiment of the invention by a heat pump system that is fired by natural gas. The system includes a power circuit and a heat pump circuit.

The power circuit uses refrigerant material as a working fluid. The refrigerant is heated and vaporized in a gas fired heater. The vaporized refrigerant is passed from the heater to a combination power and compressor unit. The vaporized refrigerant passes through a valve associated with the power unit and is directed to a driving end of the power unit. The driving end of the power unit has an enclosed first chamber wherein a first piston is movably mounted.

The first piston supports a rolling diaphragm made of resilient flexible material.

The piston and rolling diaphragm divide the first chamber into a first side and a second side. The valve of the power unit alternatively delivers vaporized refrigerant from the heater to the first side of the chamber, and then exhausts the first side of the chamber. This causes the diaphragm and the piston to move longitudinally in a first direction as pressure is applied, and then to return in the opposite direction due to forces later explained as the refrigerant is exhausted.

The refrigerant material exhausted from the first chamber is directed to a first heat exchanger. The first heat exchanger is in heat transfer relation with a first area into which heat is to be delivered. Heat is delivered from the refrigerant to the first area in the first heat exchanger and the refrigerant condenses to a liquid.

The liquid refrigerant then flows from the first heat exchanger through a positive condensate displacement pump. The positive displacement pump directs the refrigerant back to the heater. This completes the power circuit of the system.

The heat pump circuit includes a compressor portion of the power unit for compressing vaporized refrigerant material which flows in the heat pump circuit. The compressor portion includes a second chamber in a driven end of the power unit. A second piston movably mounted in the second chamber supports a rolling diaphragm therein. The piston and diaphragm divide the second chamber into a front side and a back side. The piston in the second chamber is connected to the piston in the first chamber by a rod. As a result, the pistons in the driving and driven ends of the power unit move together.

Movement of the piston in the driving end by the introduction of vaporized refrigerant, causes the second piston to compress the refrigerant vapor in the front side of the second chamber. The compressed refrigerant is pumped from the second chamber through a check valve to the remainder of the heat pump circuit. Vapor pressure from the heat pump circuit acts on the piston in the second chamber and serves to return the piston and rod assembly to begin another stroke when refrigerant vapor is exhausted from the driving end. Thereafter as refrigerant is again delivered to the driving end by the power circuit, the pistons begin another stroke. This continues and causes the pistons to undergo reciprocating action.

The high pressure refrigerant pumped from the compressor means of the driven end of the power unit is passed selectively through a four-way valve to a second coil or heat exchanger. The second heat exchanger is in fluid communication with an area to which heat is to be delivered. In the second heat exchanger, heat is transferred from the refrigerant material in the heat pump circuit to the air in the selected area and the refrigerant material condenses therein.

From the second heat exchanger the liquid in the heat pump circuit is passed through expansion means such as an expansion valve or orifice. Thereafter the fluid is passed to another coil which serves as an evaporator. The evaporator is in heat transfer relation with an area from which heat is to be removed. As heat is absorbed the refrigerant material again vaporizes. It is then passed through an accumulator to further separate any liquid from the refrigerant vapor, and is then conducted back to the compressor means in the driven end of the power unit. This completes the heat pump circuit.

The four-way valve of the system enables directing the refrigerant flow in the heat pump circuit so that the coils which serve as the evaporator and condenser can be reversed. This enables the selective reversal of the areas to and from which heat is absorbed and delivered.

The preferred embodiment of the invention also includes a bypass for the first heat exchanger. The bypass enables directing the vaporized refrigerant in the power circuit to a third heat exchanger which heats only a selected area. This enables heating in ambient temperatures below which the heat pump circuit would be ineffective.

Embodiments of the invention include a power unit having multiple first and second chambers. The first and second chambers have first and second pistons supporting first and second rolling diaphragms respectively. Each pair of first and second pistons is connected by a connecting rod and reciprocate together as in the first described embodiment. Each second chamber further includes a front side and check valves in fluid connection therewith. Refrigerant enters and undergoes compression in the second chambers and is then delivered to the remainder of the heat pump circuit.

The first chambers each have a first side. The first sides are in fluid connection with a rotary valve. The rotary valve, which includes a low friction ceramic valve element, alternately places each of the first sides in fluid communication with the heater and then with the first heat exchanger of the power circuit. The rotary valve is driven by a stepper motor which controls the speed of the pumping action. The connected first and second piston pairs are also actuated to move in opposed fashion to minimize vibration.

The system of the present invention further includes a condensate pump for the working fluid that efficiently pumps the liquid working fluid and avoids flashing of the fluid.

The high efficiency heat pump system provides higher coefficients of performance than conventional systems, has superior reliability and is less expensive to operate.

BRIEF DESCRIPTION OF DRAWINGS

FIG. 15 is a partially sectioned side view of the rotary valve of the alternative power unit and attached stepper motor.

FIG. 16 is a sectioned side view of the rotary valve with the section taken normal to the section in FIG. 15.

BEST MODES FOR CARRYING OUT INVENTION

Figure 1:
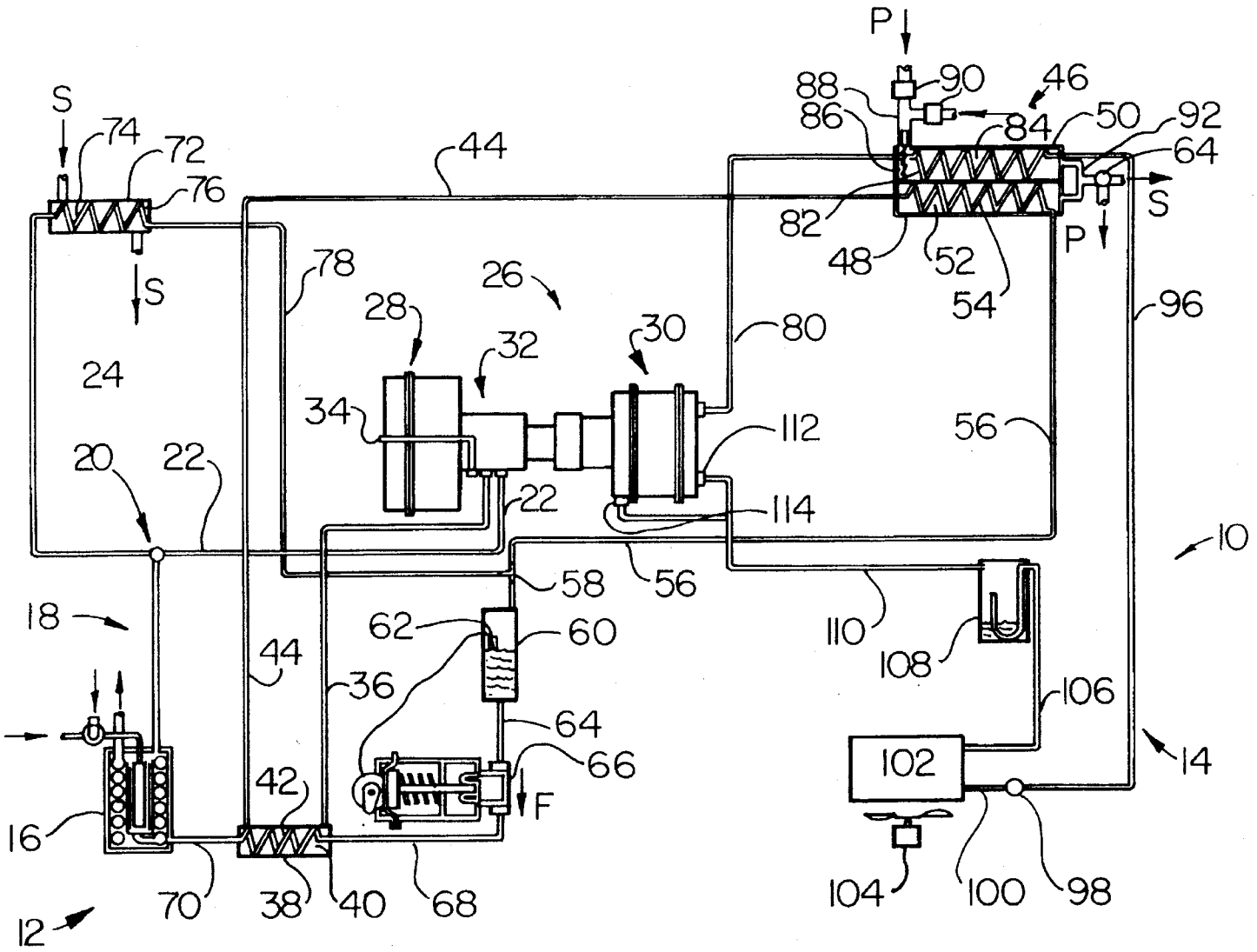
FIG. 1 is a schematic view of the preferred embodiment of the high efficiency pool heating system of the present invention.

Referring now to the drawings and particularly to FIG. 1, there is shown therein a schematic view of the preferred embodiment of the high efficiency pool heating system of the present invention, generally indicated 10. The system includes a power circuit generally indicated 12 and a heat pump circuit generally indicated 14.

The power circuit includes a gas fired heater 16 which heats a first working fluid therein. In the preferred form of the invention the first working fluid is R-22 refrigerant. The refrigerant is vaporized in heater 16 and passed through a conduit 18 to a first three-way valve 20. Valve 20 selectively delivers the vaporized refrigerant to a conduit 22 or to a conduit 24.

Conduit 22 is connected to a power unit 26 which is later described in detail. Power unit 26 includes a driving section 28, a driven section 30 and a valve section 32. Refrigerant vapor is delivered by conduit 22 to valve section 32. Valve section 32 directs the refrigerant vapor periodically in a manner later described in detail, to a conduit 34 where it is used to power driving section 28 of the power unit 26.

Vaporized refrigerant that has been used to power driving section 28 is passed out of valve section 32 to a conduit 36. Conduit 36 is connected to a heat exchanger 38. Heat exchanger 38 is a shell and tube type heat exchanger wherein the refrigerant from conduit 36 passes through a shell 40 on the outside of a tube 42. Heat exchanger 38 is constructed with a metal outer shell with an internal spiraled tube of copper material. This construction provides for excellent heat transfer between the fluids in the shell 40 and the tube 42.

From shell 40 of heat exchanger 38 the refrigerant in the power circuit passes through another conduit 44 to a compound heat exchanger 46. Heat exchanger 46 is a multiple shell and tube type exchanger and has a construction that is later described in detail. Heat exchanger 46 has a first heat exchanger portion 48 and a second heat exchanger portion 50.

First heat exchanger portion 48 has a shell 52 with a tube 54 extending therethrough. Vaporized refrigerant from conduit 44 is passed through tube 54 of the first exchanger portion. Water from a pool or spa to be heated is passed through the shell 52 in a controlled manner as later described. As a result, the refrigerant vapor in tube 54 delivers heat to the water and is condensed.

The cooled refrigerant material, which is mostly condensed in the heat exchanger, leaves tube 54 and passes into a conduit 56. Conduit 56 includes a tee 58 the purpose of which is later explained. Conduit 56 is connected to a receiver 60. Liquid refrigerant is collected in receiver 60. A float-type sensor switch generally indicated 62, is mounted in receiver 60.

Receiver 60 is in connection with a conduit 64. Conduit 64 is in connection with a pump 66. Pump 66 is a small electric motor driven diaphragm pump which includes internal check valves. The pump provides flow in the direction of Arrow F as shown. Pump 66 is operated in response to float switch 62 which detects the presence of fluid in receiver 60. Control of pump 66 by the sensor insures that the pump operates only when liquid is present and avoids flashing the refrigerant liquid in the receiver 60 to a vapor.

The liquid refrigerant passes out of pump 66 into a conduit 68. Conduit 68 is in connection with tube 42 of heat exchanger 38. As the liquid refrigerant passes through tube 42 it absorbs heat from the refrigerant vapor in the shell 40. From heat exchanger 38 the liquid refrigerant passes through another conduit 70 which delivers it back to heater 16. This completes the power circuit.

The power circuit 12 also includes a heat exchanger 72. Heat exchanger 72 is in fluid communication with conduit 24. Vaporized refrigerant is delivered to heat exchanger 72 when first three-way valve 20 is positioned so that refrigerant vapor is not being delivered to the power unit 26.

Heat exchanger 72 has an internal tube 74 through which vaporized refrigerant passes. Heat exchanger 72 also has a shell 76. Water from a spa to be heated is passed through shell 76 of heat exchanger 72 as indicated by Arrows S. The vaporized refrigerant passing through tube 74 condenses as it transfers heat to the water passing through shell 76. The condensed refrigerant passes out of heat exchanger 72 into a conduit 78. The refrigerant is then passed through tee 58 and is delivered to receiver 60. From receiver 60 the now liquefied refrigerant passes back to heater 16 in the manner previously described.

As explained later, heat exchanger 72 is used to heat water in a spa during cold weather conditions when use of the heat pump circuit would be inefficient.

Heat pump circuit 14 includes the driven section 30 of power unit 26. Driven section 30 comprises a compressor means for pumping a vapor of a second working fluid. In the preferred embodiment the second working fluid is also R-22 refrigerant material.

The driven section 30 of the power unit 26 operates from power delivered from the driving section, as later explained in the detailed description of the power unit. The refrigerant working fluid in the heat pump circuit is compressed and pumped out of the power unit through a check valve (not separately shown) into a conduit 80. Conduit 80 delivers the refrigerant vapor to second heat exchanger portion 50 of compound heat exchanger 46. The refrigerant passes through a tube 82 in the second heat exchanger portion. Water from the pool or spa to be heated passes through a shell 84 of the second heat exchanger portion as indicated by Arrows S and P.

Shell 84 of the second heat exchanger portion 50 is in fluid communication with shell 52 of the first exchanger portion 48 through a control valve 86. Control valve 86 operates in a manner later described to deliver water to the first heat exchanger portion 48 in increasing amounts as the temperature of the water to be heated increases. Control valve 86 serves to avoid cooling the refrigerant in the power circuit beyond the heating ability of heater 16 when the water is very cold.

Water piping 88 to heat exchanger 46 includes check valves 90 to prevent reverse flow. Also, outlet piping 92 from heat exchanger 46 includes a second three-way valve 94 which operates to direct the heated water to the pool or the spa under control of a controller in a manner later explained.

Refrigerant vapor which passes heat to the water flowing through second heat exchanger portion 50 condenses and passes out of the heat exchanger into a conduit 96. Conduit 96 is connected to a flow limiter 98 which serves as expansion means. Although a flow limiter is used in the preferred embodiment of the system of the present invention, it will be understood by those skilled in the art that in other embodiments an expansion valve, capillary tube or other types of expansion means may be used.

Flow limiter 98 is connected to another conduit 100 which carries the expanded refrigerant material to an evaporator 102. Evaporator 102 is a conventional heat exchanger means in which heat from the ambient air is absorbed by the refrigerant which causes it to vaporize. To aid in heat transfer from the air to the refrigerant, the evaporator 102 includes a blower 104 for passing air through the evaporator.

The vaporized refrigerant from evaporator 102 passes through a conduit 106 to a suction accumulator 108. Accumulator 108 serves as means for separating any liquid refrigerant that passes into the accumulator and insures that only vapor passes out of the accumulator.

Refrigerant vapor passes out of accumulator 108 to a conduit 110. Conduit 110 is connected to an inlet 112 of the driven section 70 of the power unit 26. The vaporized refrigerant material is again compressed and passes through the power circuit. Conduit 110 is also in connection with an equalization port 114 of power unit 26. The purpose of the equalization port will be made apparent in conjunction with the detailed description of the power unit.

Figure 2:
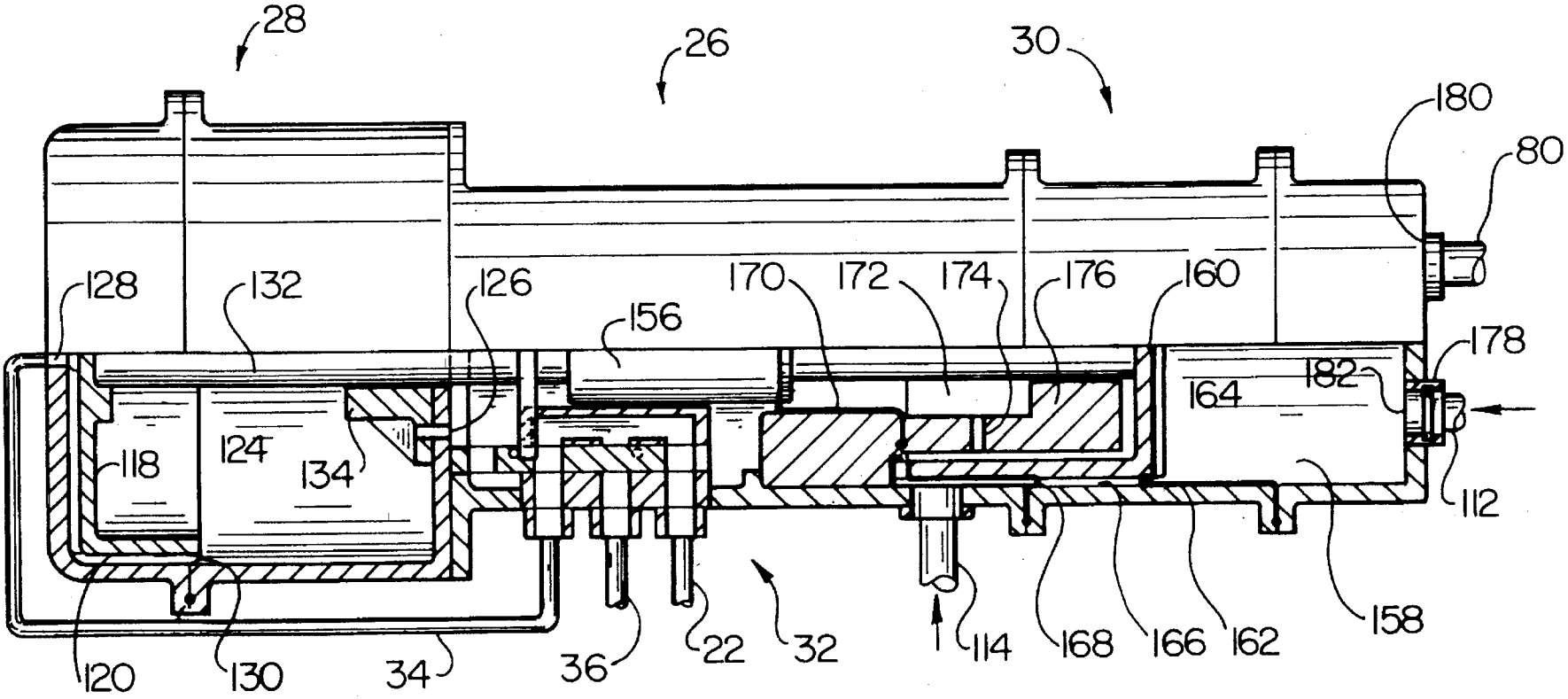
FIG. 2 is a partially sectioned view of the power unit with the first piston positioned at the beginning of a power stroke.
Figure 3:
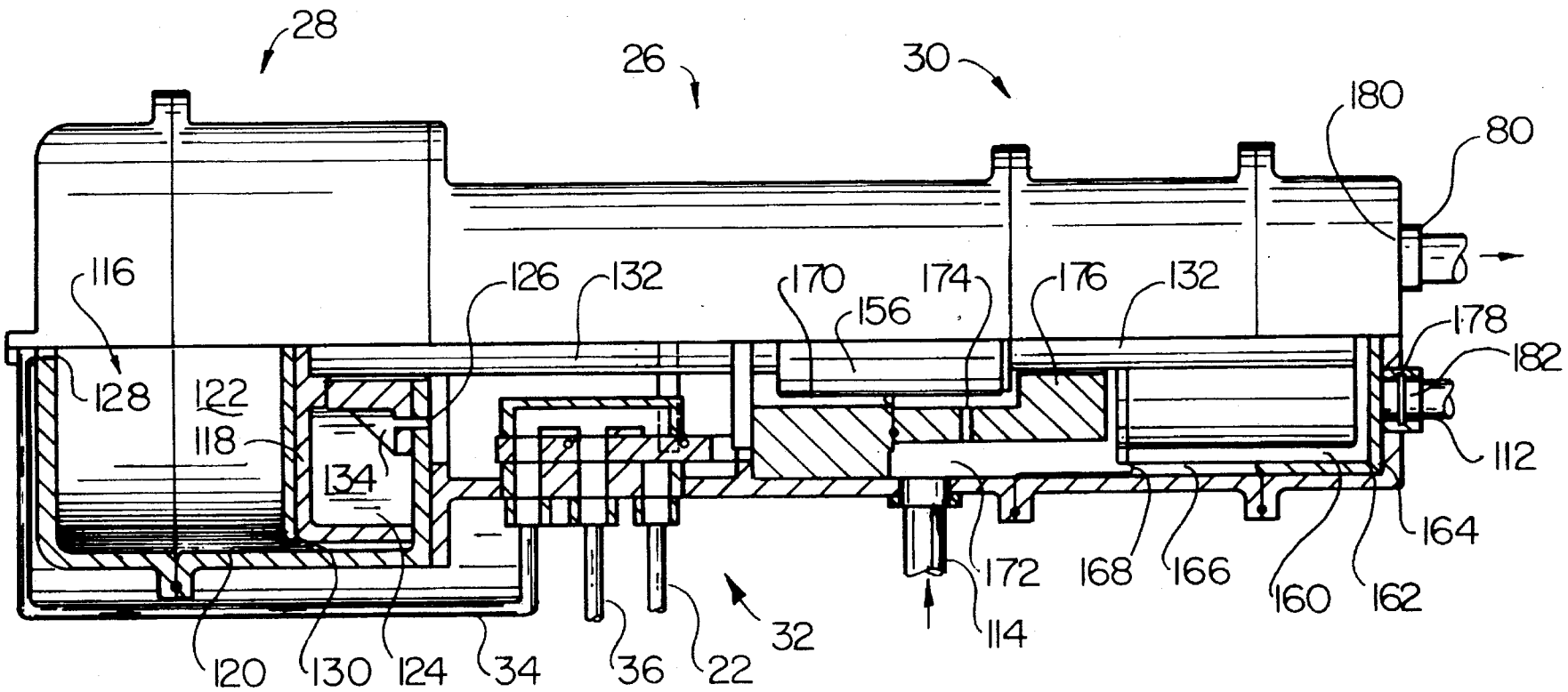
FIG. 3 is a partially sectioned view of the power unit with the first piston positioned at the beginning of a return stroke.

A novel aspect of the system of the present invention is the power unit 26, a first embodiment of which is shown in detail in FIGS. 2 and 3. The driving section 28 of the power unit has an enclosed first chamber 116. A first piston 118 is positioned in the first chamber and is movable longitudinally therein. First piston 118 is a split piston which has a detachable face.

A first rolling diaphragm 120 is supported on piston 118. Rolling diaphragm 118 is of the fabric elastomer type and in the preferred embodiment is manufactured by Bellofram. In the preferred form of the invention the rolling diaphragm is designed to withstand temperatures of 500 degrees F. and pressures of 1500 PSI. The rolling diaphragm is captured between the face and the main body of piston 118 and moves with the piston to provide a seal between the outer wall bounding chamber 116 and the piston. The rolling diaphragm provides a seal with virtually no frictional resistance to movement.

Rolling diaphragm 120 divides first chamber 116 into a first side 122 and a second side 124. Second side 124 is open to atmosphere through an opening 126 in the housing of the power unit 26. In other embodiments, second side 124 may be directed through a valve mechanism to a condenser or similar heat exchanger. This would capture any refrigerant that may leak through the diaphragm.

Valve section 32 of power unit 26 which is later described in detail, is connected to conduit 34. Conduit 34 is connected to an opening 128 which is open to the first side of chamber 116. Valve section 32 in a first condition supplies vaporized refrigerant from heater 16 to the first side 122 of the piston 118. In this first condition of the valve section shown in FIG. 2, the piston is pushed towards the right by the fluid pressure of the vaporized refrigerant.

In a second condition of the valve section 32 shown in FIG. 3, flow from the heater into the power unit is prevented. At the same time first side 122 and conduit 134 are open to conduit 36, which carries refrigerant to heat exchanger 28. As a result refrigerant exhausts from first chamber 116. With the pressure of the refrigerant vapor relieved, piston 118 is no longer pushed to the right as shown in FIG. 3. As a result the piston is enabled to move to the left in response to forces applied by the driven end 30 of the power unit 26 as later explained. Due to the repeated cycling of valve means 32, piston 118 reciprocates back and forth in the first chamber.

Rolling diaphragm 120 provides an advantage in the construction of power unit 26 in that it provides a fluid tight seal for piston 118 and yet poses little resistance to movement. The rolling diaphragm is also durable. This is because the rolling diaphragm 120 is supported by adjacent surfaces at all points except in small folds 130 which extend about the periphery of the piston plate. This lowers the force applied to the rolling diaphragm and minimizes the risk of rupture.

Piston 118 is connected to a rod 132 which extends from the piston through the second side 124 of the first chamber. Rod 132 is supported in a bearing 134 at the rear of the driving section 28. Bearing 134 enables rod 132 to move longitudinally with piston 118.

Rod 132 extends through valve section 32. Valve section 32 is shown in greater detail in FIGS. 4 through 7. Valve section 32 has a valve body 136. Valve body 136 is attached to a manifold 138 which is connected to conduits 22, 36 and 38 as shown. A slide 140 is movably mounted in valve body 136. Slide 140 includes first, second and third passages 142, 144 and 146 respectively. Slide 140 also has a first pin 148 extending outward therefrom on a first side and a second pin 150 extending therefrom on an opposed side from pin 148.

A first trip arm 152 extends from rod 132 on a side of the rod where first pin 148 is located. A second trip arm 154 extends from rod 132 on an opposed side where second pin 150 is located.

Figure 4:
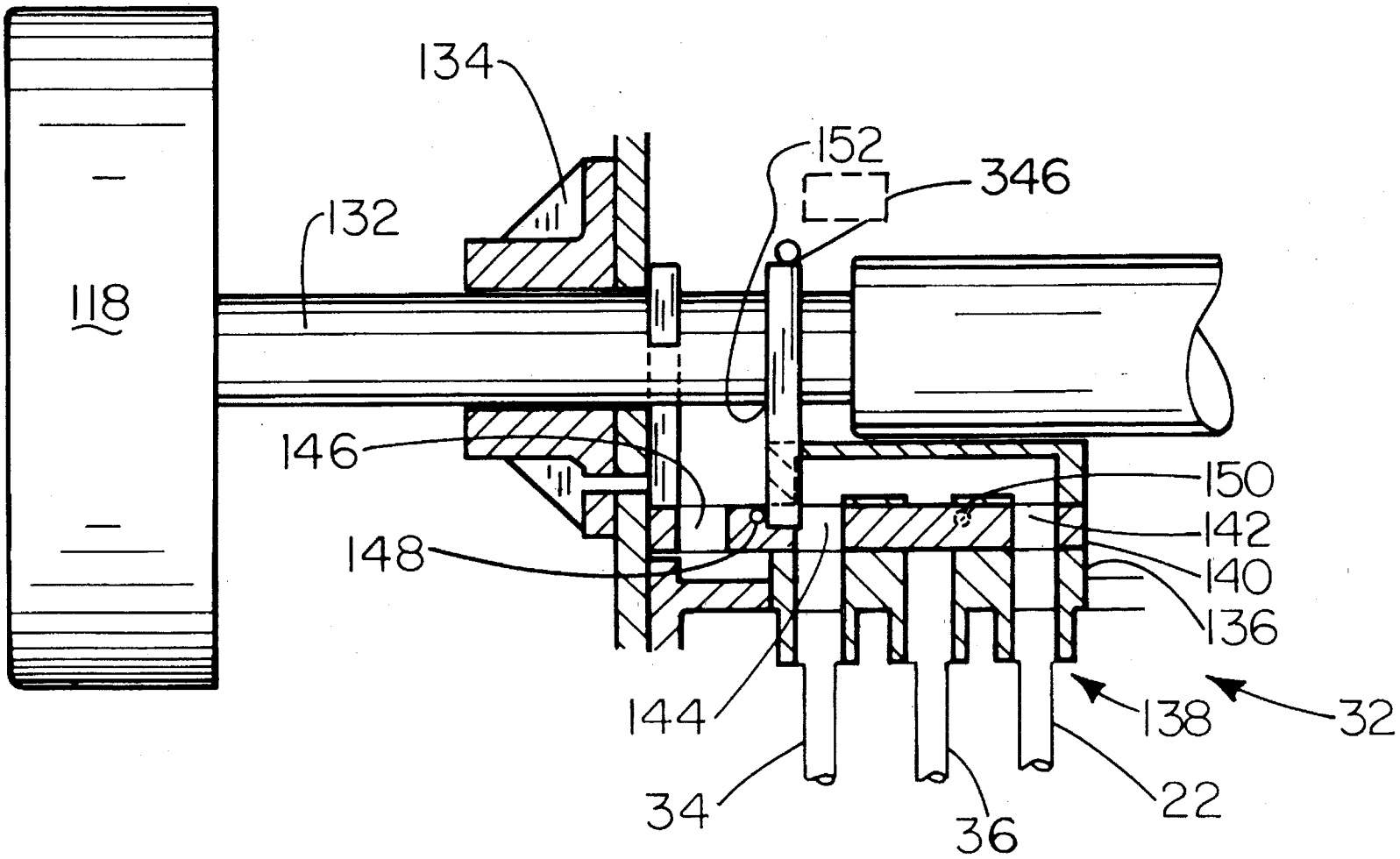
FIG. 4 is a partially sectioned view of the slide valve of the power unit shown in its position when the first piston is in a power stroke.
Figure 5:
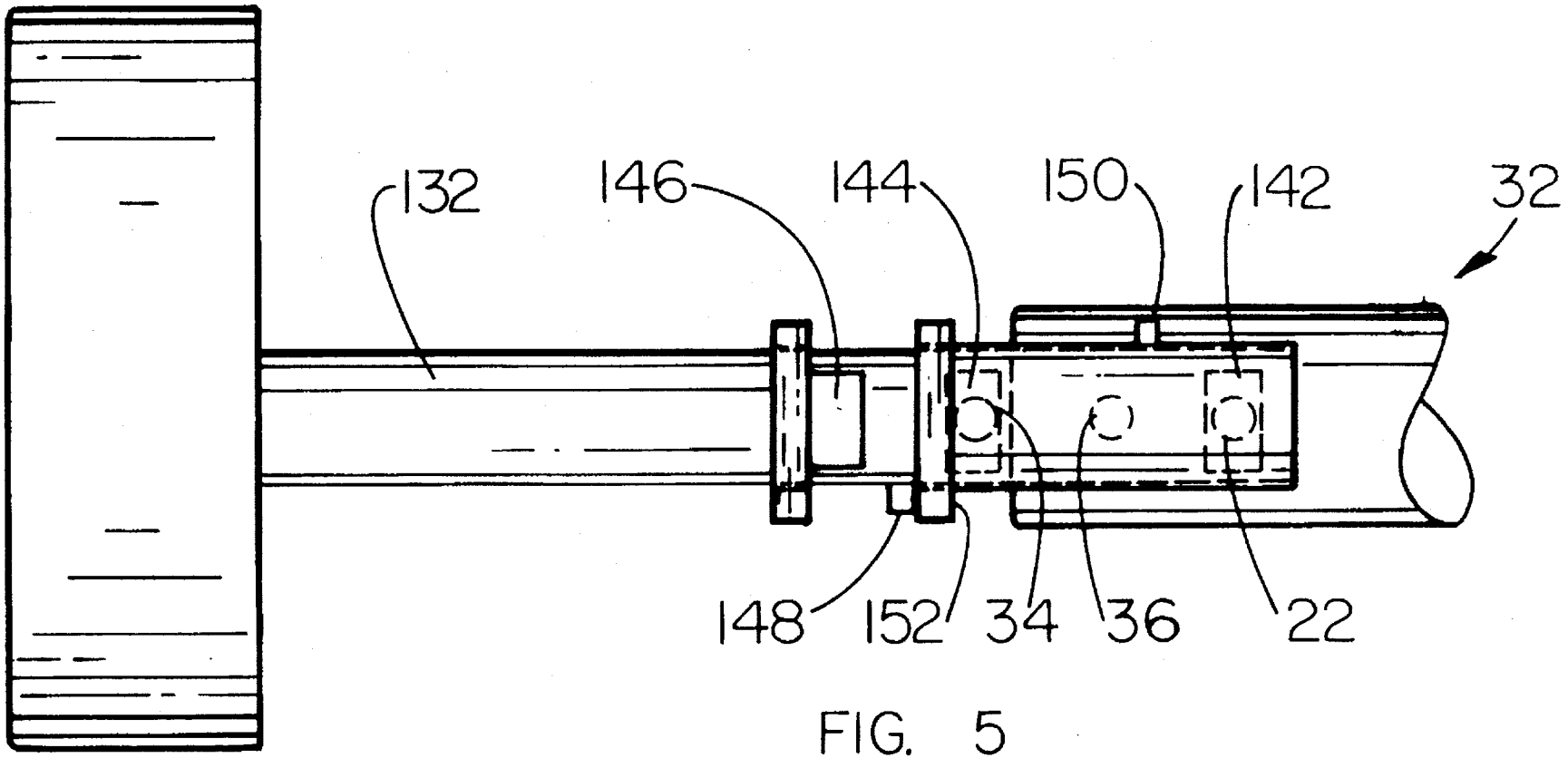
FIG. 5 is a top view of the slide valve in the position shown in FIG. 4.

As shown in FIGS. 4 and 5, when rod 132 is fully extended to the left, trip arm 152 engages first pin 148 and moves slide 140 to the first position. In the first position, first passage 142 enables refrigerant vapor delivered through conduit 22, to pass through a valve body 136 and exit through third passage 144. In this condition vapor is delivered to conduit 34. Refrigerant vapor delivered through conduit 34 enters first chamber 116 and causes piston 118 and rod 132 to move to the right. In this first condition of the valve portion, slide 140 is positioned so that no flow is allowed either into or out of conduit 26.

As piston 118 and rod 132 move to the right, trip arm 152 disengages first pin 148. However, slide 140 continues to maintain its first position continuing the delivery of refrigerant vapor to first chamber 116. Eventually movement of rod 132 causes second trip arm 154 to engage second pin 150. Further movement of rod 132 to the right causes slide 140 to be moved to the second position shown in FIGS. 6 and 7.

In the second position, slide 140 is positioned such that second passage 144 is in connection through valve body 136 with third passage 146. This places conduits 36 and 34 in fluid communication. In the second position of slide 140 flow to conduit 32 is blocked. As a result, refrigerant is enabled to flow out of first chamber 116 through conduit 34. Refrigerant vapor passes through the valve portion and exhausts through conduit 36. The release of refrigerant vapor enables piston 118 and rod 132 to be moved back in the direction to the left as shown in response to forces applied to the rod by the driven end of the power unit.

Figure 6:
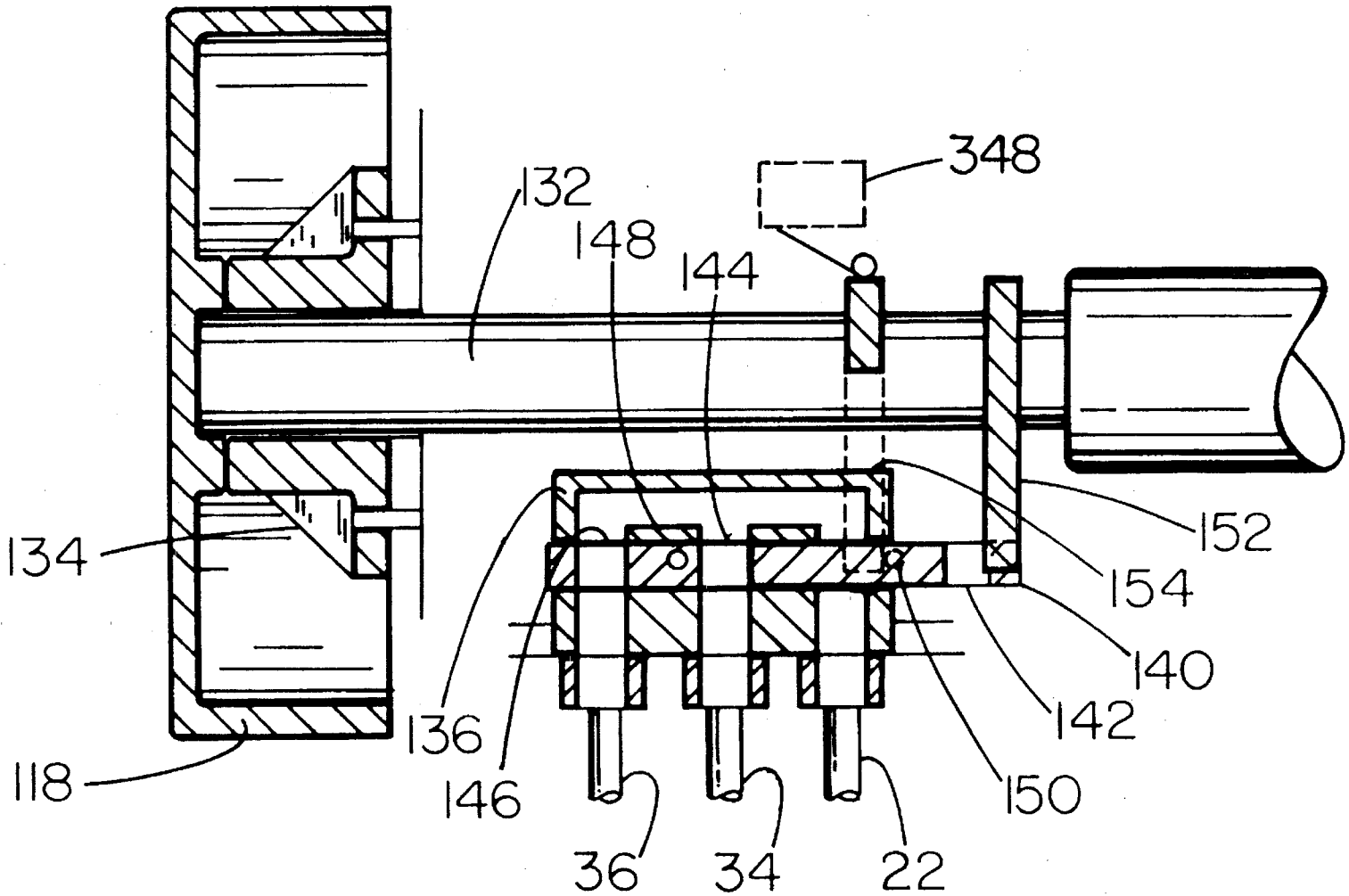
FIG. 6 is a partially sectioned view of the slide valve of the power unit shown in its position when the piston is in a return stroke.
Figure 7:
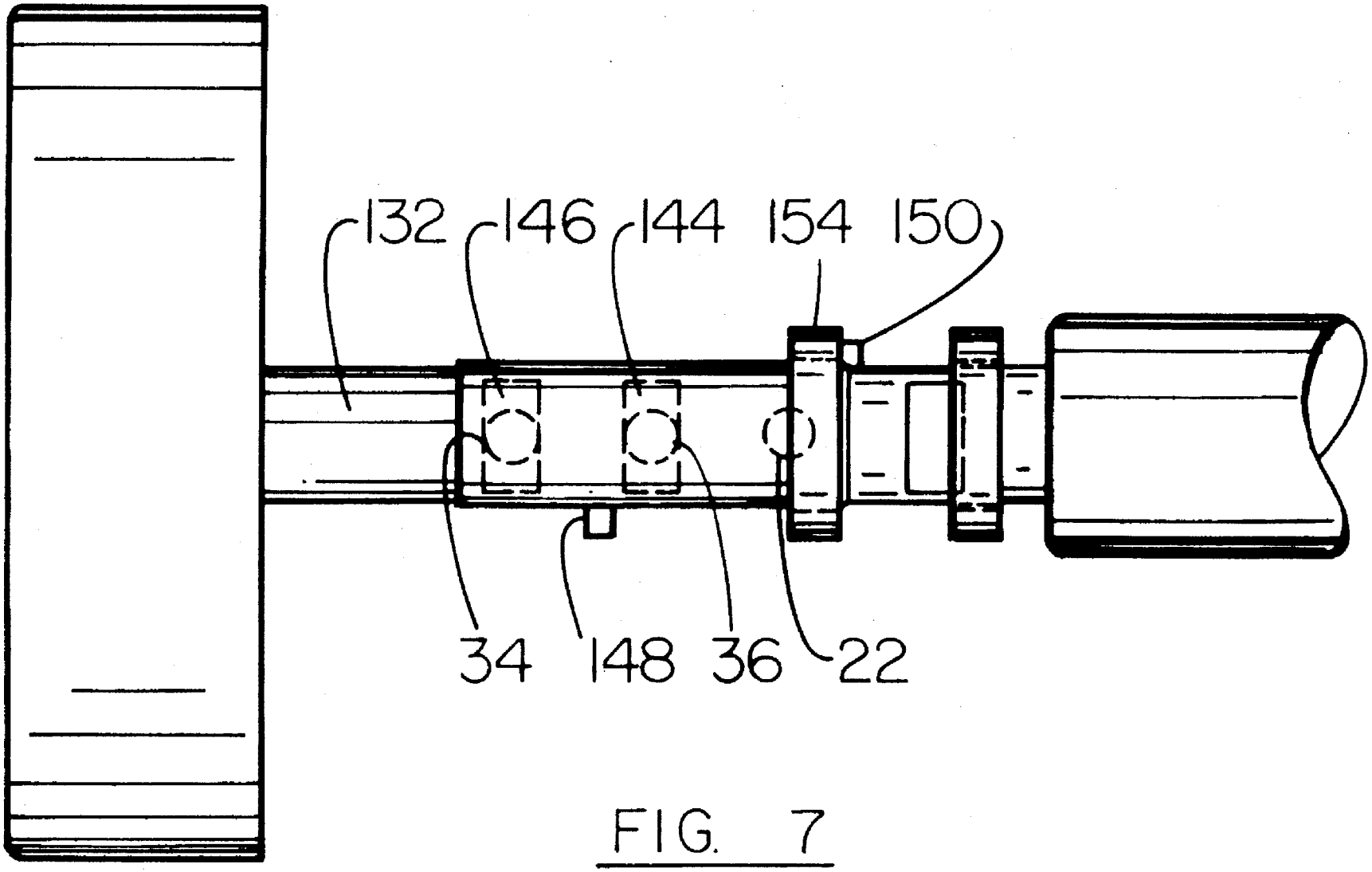
FIG. 7 is a top view of the slide valve in the position shown in FIG. 6.

Valve section 132 remains in the second condition shown in FIGS. 6 and 7 until rod 132 is fully moved to the left, and slide 140 again moves toward the position shown in FIGS. 4 and 5. As the rod moves, the first trip arm 152 moves pin 148 and slide 140 to the first position so that refrigerant is again supplied to the first side of the piston. The cycle is then repeated causing piston 118 to reciprocate.

In the preferred embodiment of the invention, slide 140 and the abutting surfaces of the valve body, are made of ceramic material that is lapped to very close tolerances. The adjacent surfaces are held together by spring pressure supplied by leaf springs (not shown) to provide a good seal while enabling the slide to readily move between the first and second positions. As will be understood by those skilled in the art, and as later shown in the description of the alternative embodiment of the power unit, in other embodiments of the invention other types of valves may be used.

Referring again to FIGS. 2 and 3, the driven section 30 of the power unit is hereafter described. Rod 132 includes an enlarged section 156 which divides the driving section 28 and the driven section 30. The driven section 30 includes a second chamber 158 in which a split second piston 160 is positioned. Second piston 160 is sized to be movable in chamber 158 and is attached to rod 132 for movement therewith.

A second rolling diaphragm 162 extends across second chamber 158 and is supported on piston 160. Rolling diaphragm 162 is made of similar material to rolling diaphragm 120. Rolling diaphragm 162 divides chamber 158 into a front side 164 and a back side 166.

An isolating diaphragm 168 extends across the back of piston 160 and bounds back side 166. A return diaphragm 170 extends across enlarged portion 156 of rod 132. Rod 132 is manufactured to include means for splitting the rod in the area of diaphragm 170. This enables the rod to pass through an opening in diaphragm 170 while still maintaining a fluid tight seal.

Diaphragms 168 and 170 are both rolling diaphragms and bound a third chamber 172. As represented schematically by passage 174, third chamber 172 extends on both sides of a bearing support 176 which supports rod 132 in the driven section while enabling it to move longitudinally.

As shown in FIGS. 2 and 3, equalization port 114 is open to third chamber 172. This results in the pressure of the refrigerant in the accumulator pushing against second piston 160. This pressure tends to help move the piston to the right when rod 132 is moved in that direction. The pressure in third chamber 172 also provides force in an opposed direction through action on diaphragm 170 which aids in moving rod 132 to the left as well.

Front side 164 of driven end 30 is also in fluid communication with conduit 80 and inlet 112 through openings 180 and 182 respectively. Positioned in openings 180 and 182 are check valves 178, only one of which is shown. Check valves 178 are metal flapper type check valves which, in the preferred embodiment, are of the type made by the De-Sta-Co Division of Dover Company. The valve positioned in opening 182 permits flow only into front side 164 of chamber 158. Likewise the valve in opening 180 only permits flow out of the front side of the chamber. Refrigerant vapor from accumulator 108 enters front side 164 through check valve 178 in opening 182. As fluid is entering opening 182, the check valve in opening 180 is closed. The pressure of the refrigerant in the first side 164 as well as pressure in the third chamber 162, tend to move piston rod 132 to the left as refrigerant is exhausted from first chamber 116 by valve section 32. As a result, first side 164 of the driven section fills with refrigerant vapor as piston 160 and rod 132 move to the left. Eventually front side 164 fills with refrigerant vapor when piston 160 moves fully to the left.

When valve section 32 changes its condition so that refrigerant vapor is again delivered to the driving section of the power unit, piston 118 begins moving to the right. Because piston 160 is connected through rod 132 to piston 118, piston 160 also begins moving correspondingly to the right. As a result, the refrigerant in front side 164 of the driven section is compressed. The check valve 178 in opening 180 opens in this condition while the oppositely directed check valve in opening 182 closes. As piston 160 moves to the right assisted by the pressure in third chamber 172, the refrigerant vapor is forced out of the driven section and into conduit 80. The working fluid then travels to the remainder of the heat pump circuit.

When pistons 160 and 118 reach the full extent of their travel to the right, valve section 32 reverses its condition as previously described, and refrigerant vapor is again exhausted from the driving section of the power unit. At the same time refrigerant vapor begins entering the driven section of the power unit as the piston assembly moves back to the left. This cycle is repeated periodically by the power unit which efficiently uses the power of the refrigerant vapor in the power circuit to compress the refrigerant vapor in the heat pump circuit.

Power unit 26 provides a high efficiency compressor with limited losses due to its rolling diaphragm construction. It is also a reliable component because of its simplicity and limited number of moving parts.

An alternative embodiment of the power unit of the system of the present invention, generally indicated 282, is shown in FIGS. 13 through 17. Power unit 282 includes four bodies or power modules 284. Each power module 284 is similar in constitution to power unit 26 of the first embodiment. Each power module includes a driving section and a driven section with pistons supporting rolling diaphragms in each end. Each pair of pistons in a power module is connected by a rod. The power modules 284 of the alternative embodiment are held in position by a support bracket 286.

The driven sections of power modules 284 include check valves similar to the check valves on the driven section of power unit 26. An intake manifold 288 is connected to conduit 110 and delivers vaporized refrigerant into the driven sections of the power modules as indicated by the arrows. Intake manifold 288 is also connected to an equalization line 289 which is connected to equalization ports on the power modules. An exhaust manifold 290 releases compressed refrigerant from the driven sections of the power modules and delivers it to conduit 80.

The power modules 284 of the power unit 282 differ from power unit 26 in that each module does not have a valve section comparable to valve section 32. Instead, flow to and from the first sides of the driving sections of the power modules is controlled by a rotary valve assembly 292.

As shown in detail in FIG. 15, rotary valve assembly 292 includes a frame 294. A valve body 296 is mounted on frame 294. Valve body 296 includes a first plate member 298 and a second plate member 300. A rotatable valve element 302 is positioned between the first and second plate members. The first plate member 298, second plate member 300 and valve element are held in compressed relation by spring fingers 304 of frame 294.

In the preferred form of the invention the first and second plate members and the valve element are made of ceramic material. The facing surfaces of the valve element and the abutting surfaces of the plate members are contoured to be precisely flat and have lapped surfaces. This reduces frictional resistance to movement of the valve element.

Valve assembly 292 further includes an electric stepper motor 306 which has a shaft 308. Shaft 308 extends through an opening in plate member 298 and is attached to rotatable element 302.

Rotatable element 302 includes first and second fluid passageways 310 and 312 respectively. The fluid passageways 310 and 312 are 180 degrees apart and are in connection with fluid openings on the opposed facing surfaces of element 302.

Plate member 298 includes a first fluid opening 314 in the surface abutting element 302. Opening 314 is in fluid communication with a duct 316 that is connected to heater 16 through conduit 22.

Plate member 300 includes a second fluid opening 318 which is in fluid connection with a duct 320. Duct 320 is in connection with conduit 36.

Plate member 300 further includes a third fluid opening 322 which is in fluid communication with a duct 324. Duct 324 is in fluid communication with the first sides of two of power modules 284. Preferably, the power modules connected to duct 324 are positioned opposite rather than adjacent to one another in support bracket 286.

Plate member 298 further includes a fourth fluid opening 326. Fluid opening 326 is connected to a duct 328. Duct 328 is connected to the first sides of the power modules not connected to duct 324.

Valve assembly 292 operates similar to the slide valve previously described in that when the openings of the fluid passages 310, 312 in the valve element 302, overlap with the openings in the abutting surfaces of the plate members 298, 300, fluid flows. In the condition shown in FIG. 15, vapor is delivered to the two power modules connected to duct 324 while vapor is exhausted from the power modules connected to duct 328.

FIG. 16 shows the valve body 292 in section 90 degrees from the section shown in FIG. 15. The valve element 302 is also rotated 90 degrees from the position shown in FIG. 15. In this position first fluid passage 310 is open to a fifth fluid opening 330 in the abutting surface of plate member 298. Opening 330 is in fluid communication with a duct 332. Duct 332 receives vapor from heater 16 through conduit 22.

Plate member 300 includes a sixth fluid opening 334 which is in fluid communication with a duct 336. Duct 336 is in fluid communication with conduit 36 and delivers gas to first heat exchanger portion 48.

A seventh fluid opening 338 extends in the abutting surface of plate member 300. Seventh fluid opening is in fluid communication with a duct 340. Duct 340 is connected with duct 328 and is therefore in fluid communication with the first sides of the power modules connected to duct 328.

An eighth fluid opening 342 in plate member 298 is connected to a duct 344. Duct 344 is connected to duct 324 and is connected to the first side of the power modules connected to duct 324.

Figure 17:
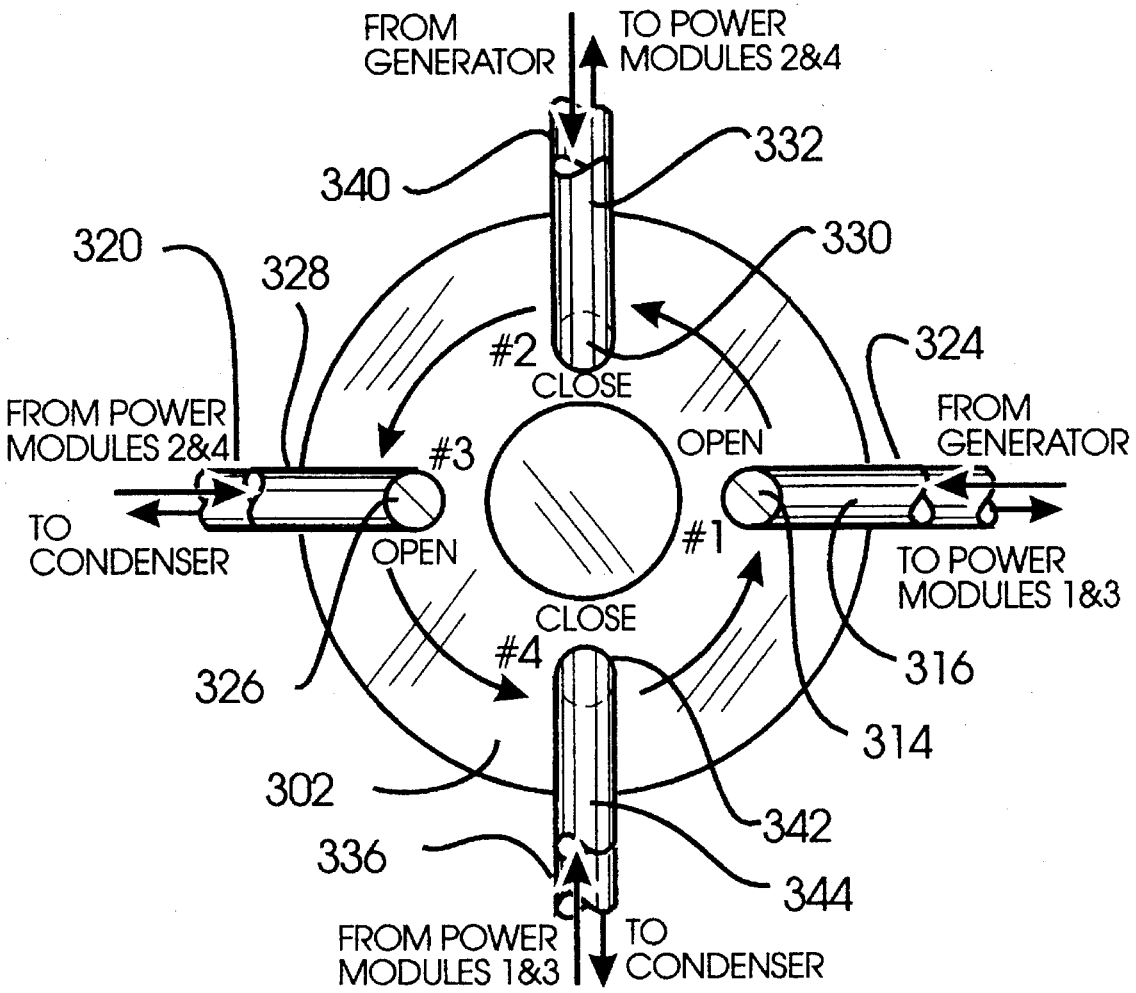
FIG. 17 is a top view of the rotary valve shown in the valve position of FIG. 15.

When rotatable valve element 302 is in the position shown in FIG. 15, vapor from the heater 16 is directed to duct 324 which delivers vapor to the first side of two of the power modules. This causes the second working fluid to be compressed in the driven sections of those two power modules. At the same time, the other two power modules exhaust vapor from their first sides through duct 328. In this position of valve element 302, fluid openings 330, 334, 338 and 342 are blocked by the abutting flush facing surfaces of the valve element as shown in FIG. 17. As a result no fluid flows in ducts 332, 336, 340 or 344.

Subsequently, stepper motor 306 rotates valve element 302 to the position shown in FIG. 16. In this position the power modules that had been supplied with vapor in FIG. 15 through duct 324, now exhaust through duct 344. Likewise, the other power modules previously exhausting through duct 328 are now supplied with vapor through duct 340. Of course, in the position of the valve element shown in FIG. 16, ducts 316, 320, 324, and 328 are in a no flow condition.

Figure 13:
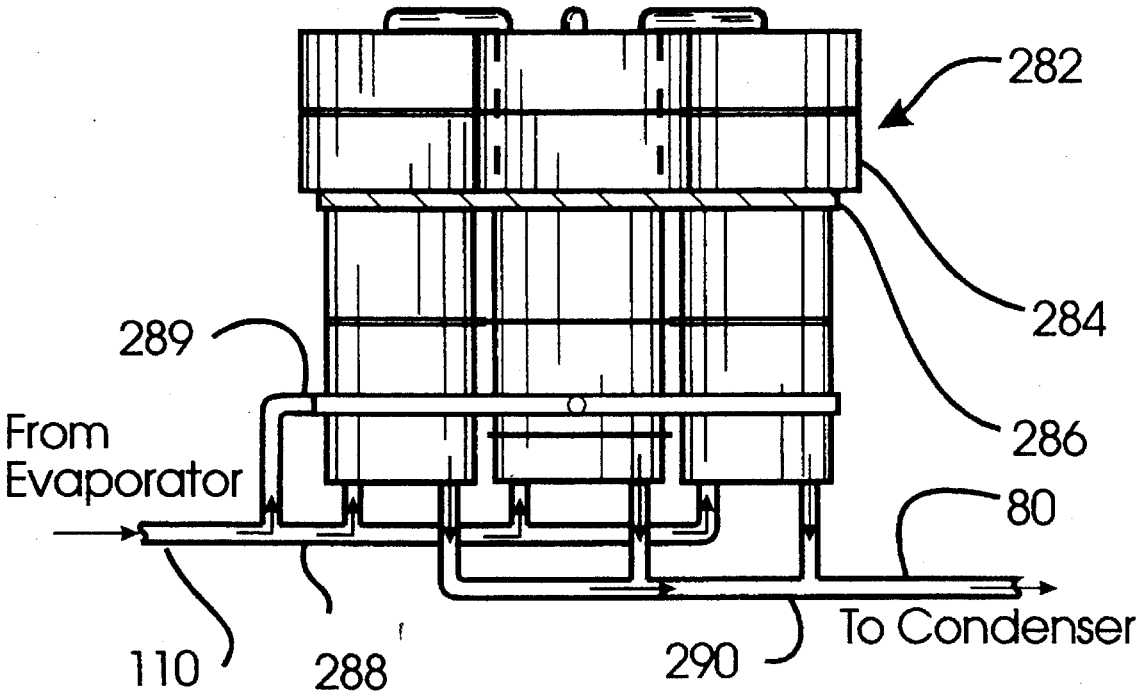
FIG. 13 is a side view of an alternative embodiment of the power unit of the present invention.

The stepper motor can be controlled by conventional circuitry well known in the prior art. Preferably the power modules include trip arms for actuating electrical limit switches (shown schematically as 346 and 348 in FIGS. 4 and 6). The limit switches detect when the pistons and connecting rod in the power module are in the either fully "up" or "down" position as shown in FIG. 13. As soon as the pistons in the first pair of power modules that move together are fully up, and the pistons in the second pair are fully down, the limit switches all trip and the circuitry rotates stepper motor 306 and valve element 302, 90 degrees. The circuitry then waits until the limit switches show the pistons in the first pair fully down and the second pair fully up, at which point the stepper motor indexes valve element 302 another 90 degrees to begin returning the pistons in the power modules back to the starting positions.

While the preferred embodiment of the stepper motor control employs limit switches actuated by trip arms on the connecting rods, in other embodiments other sensors may be used. In addition, other embodiments may rotate motor 306 in response to signals generated by a timing program in a processor. Such a timing program may control the cycling speed of the power modules in response to sensors that detect the degree of load on the system. This enables the system to increase or slow compressor speed in response to heating demand.

The alternative power unit design has advantages in that it has reduced vibration because the piston pairs in the power modules move opposite to one another. The design is also adaptable to heat transfer systems of various capacities because units can be made with varying numbers of similar power modules.

Figure 8:
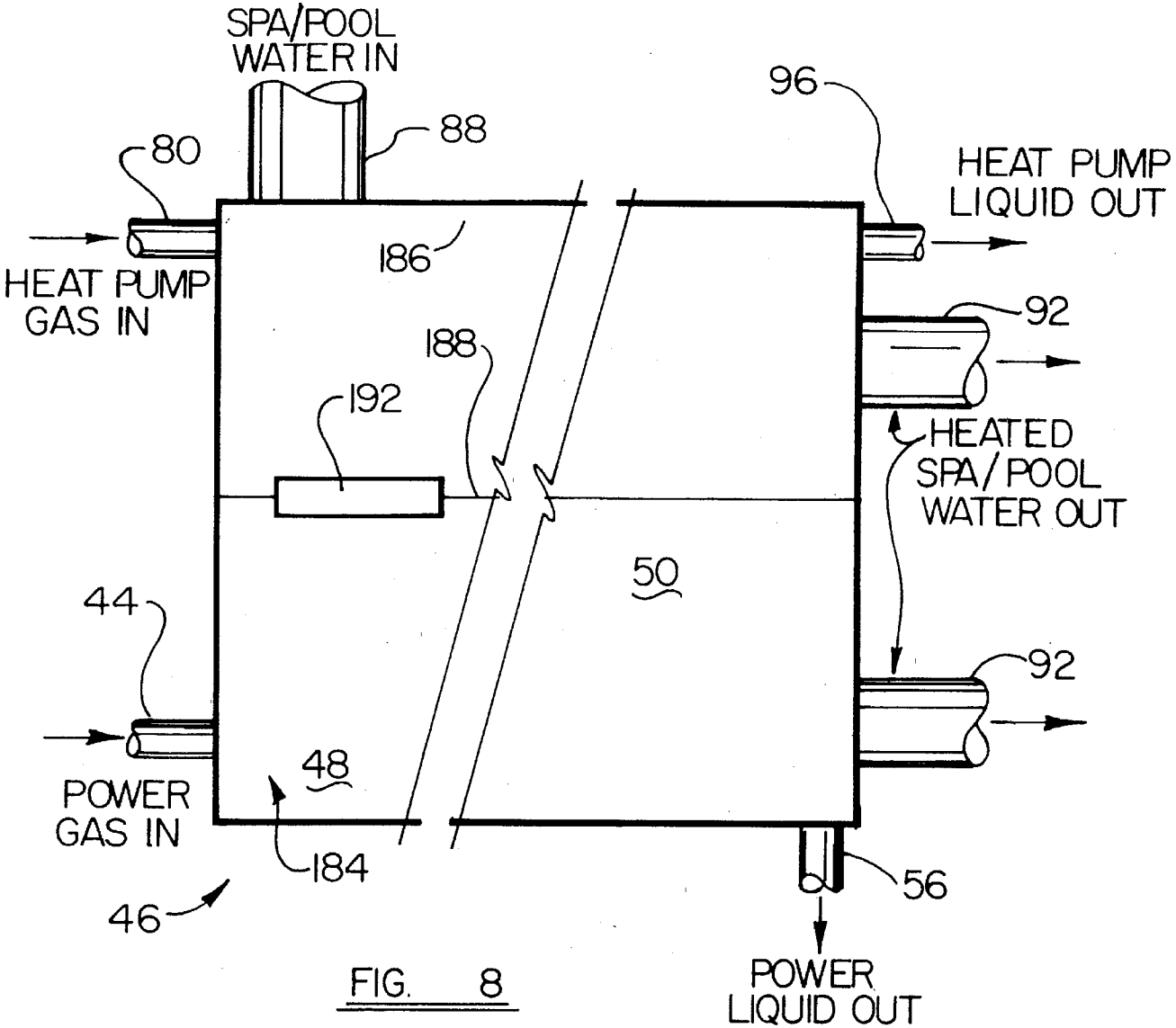
FIG. 8 is a side view of the compound heat exchanger assembly of the preferred embodiment of the system of the present invention.
Figure 9:
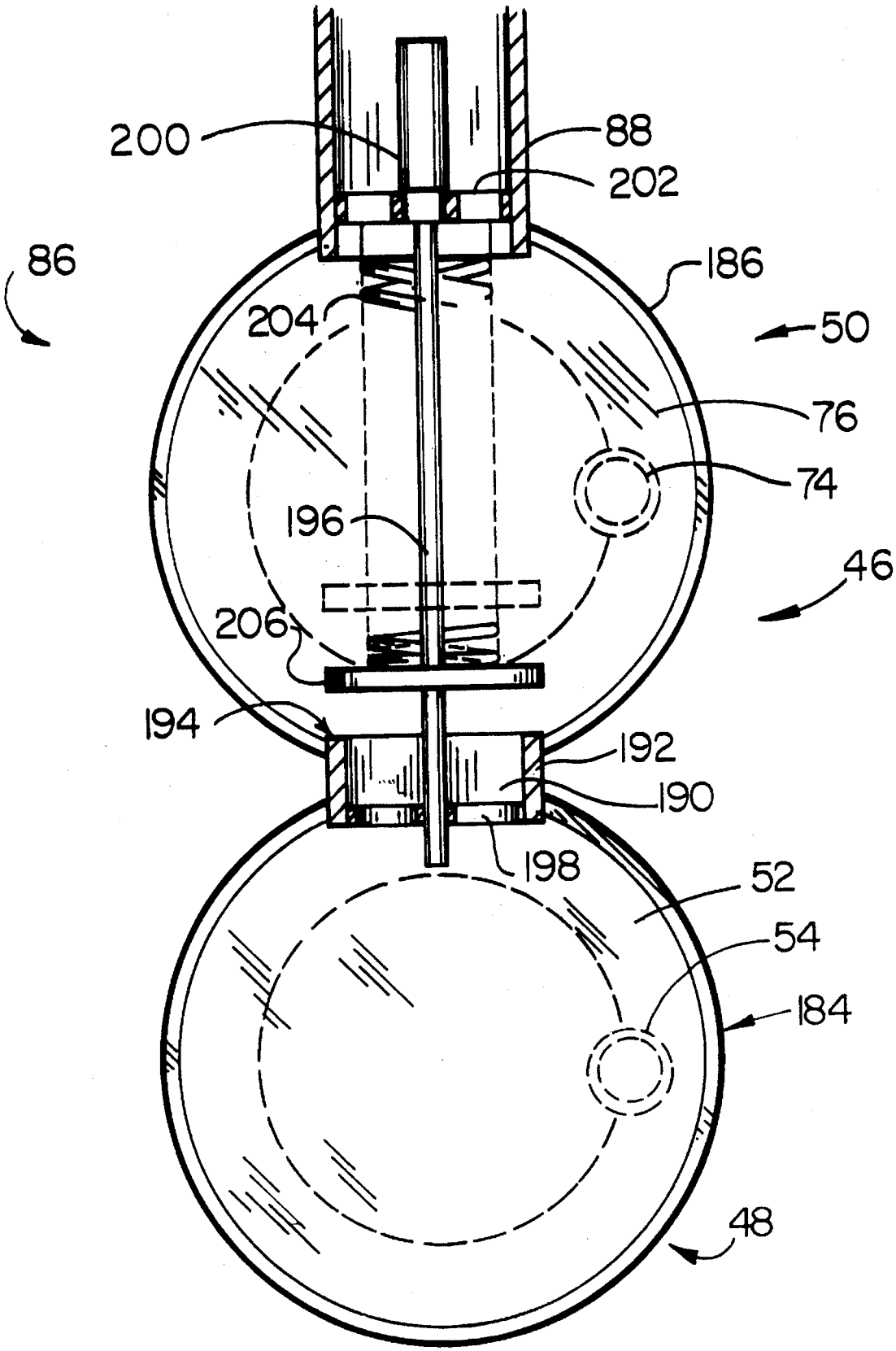
FIG. 9 is a partially sectioned view of the compound heat exchanger and the control valve housed therein.

A further novel aspect of the high efficiency pool heating system of the present invention is the construction of the compound heat exchanger 46 which is shown in detail in FIGS. 8 and 9. First heat exchanger portion 48 and second heat exchanger portion 50 have cylindrical housings 184 and 186, respectively. Housings 184 and 186 are joined along a seam 188. In the preferred form of the invention, housings 184 and 186 are made of plastic material to avoid corrosion.

Tube 54 of the first heat exchanger portion 48 carries refrigerant therein. In the preferred form of the invention tube 54 is a spiral tube of cupra-nickel material. Water from the pool or spa to be heated passes through the shell 54 of the first heat exchanger portion and cools the refrigerant vapor in tube 54 causing the refrigerant to condense.

Second heat exchanger portion 50 in the preferred embodiment also has a spiral tube 74 of cupra-nickel material which carries refrigerant vapor in the heat pump circuit. Water from the spa or pool passes in the shell 76 on the inside of housing 186 to condense the refrigerant flowing in tube 74.

Housings 184 and 186 are not in fluid communication except through an opening 190. The flow through opening 190 is controlled by control valve 86. Opening 190 is bounded by a nipple 192 having a top flange 194. An actuator rod 196 extends through the center of opening 190 and is supported therein by a support plate 198 which has openings (not separately shown) through which water may flow. Rod 196 is vertically movable in an opening in support plate 198.

Actuator rod 196 is connected to a temperature responsive actuator 200. Actuator 200 is mounted in the incoming water piping 88 to sense the temperature thereof. In the preferred embodiment of the invention, actuator 200 is a wax driver which houses a wax that expands and contracts to move rod 196 upward with increasing temperature and downward with decreasing temperature. Actuator 200 is mounted on a support plate 202. A compression spring 204 is mounted in abutting fashion with support plate 202. The opposed end of compression spring 204 abuts a valve disk 206 which is fixably mounted on rod 196.

In operation of control valve 86, when the water entering the compound heat exchanger from the pool or spa is cold, valve disk 206 is only slightly disposed from the top flange 194 of nipple 192. As a result most of the water flowing into compound heat exchanger 46 from water piping 88 flows into the second heat exchanger portion 50 and is heated by the refrigerant in the heat pump circuit.

As the water temperature increases the actuator 200 moves rod 196 upward against the force of spring 204. Valve disk 206 moves to the position shown in phantom increasing the flow of water to the first heat exchanger portion 48. As a result, the incoming water is more evenly split between the heat exchanger portions.

Control valve 86 functions to help the system operate more effectively when the water to be heated is cold. If the refrigerant in the power circuit were allowed to cool beyond the heating ability of the heater 16, the power unit would not run the heat pump circuit as effectively. Avoiding overcooling of the refrigerant in the power circuit insures that better performance is achieved when the system begins operating when the water is very cold.

Figure 10:
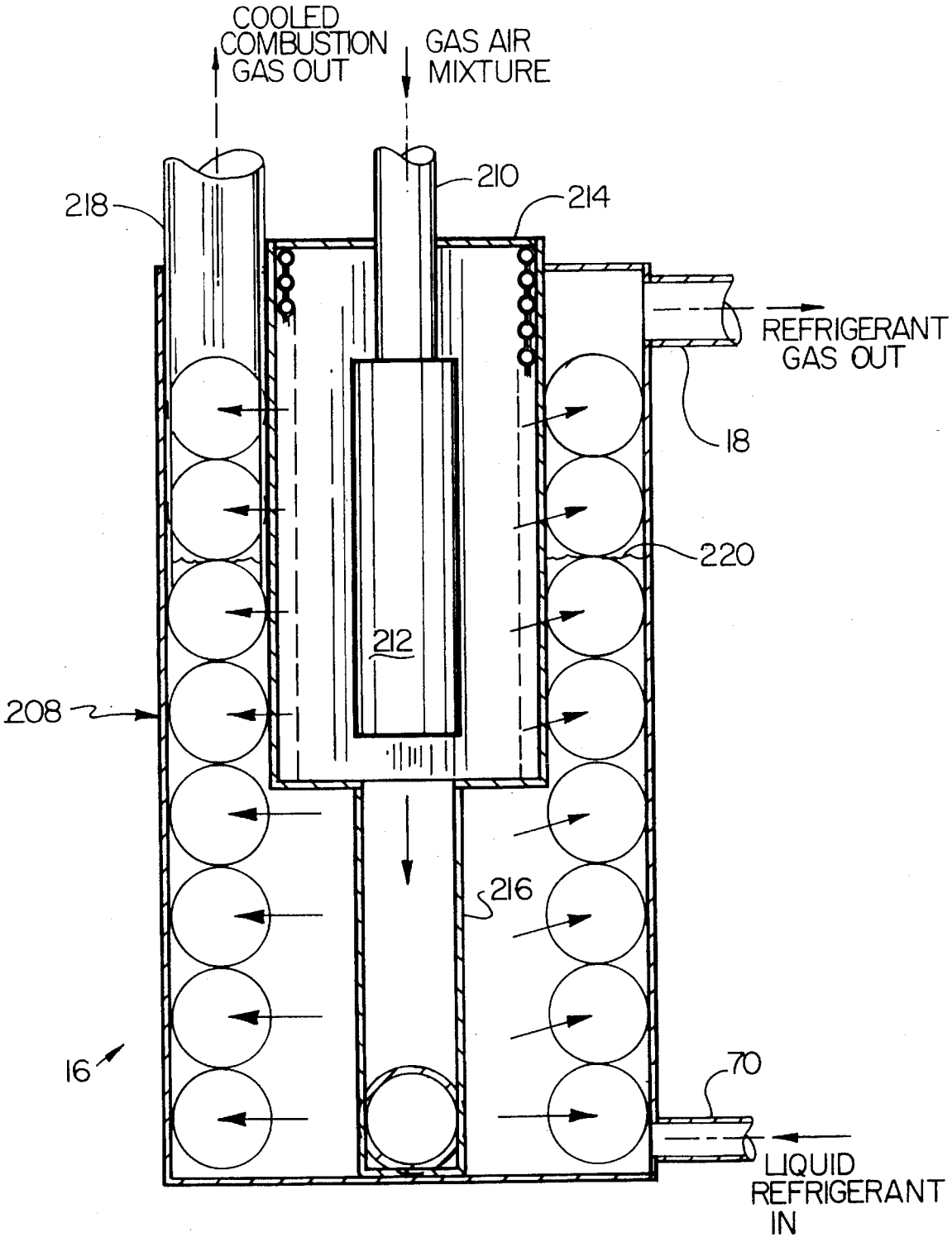
FIG. 10 is a sectional view of the gas fired heater of the power circuit.

The heater 16 of the high efficiency pool heater system is also novel in many aspects. It is shown in detail in FIG. 10. The heater 16 has a housing 208 of stainless steel material. A natural gas and air mixture is injected into the heater through an inlet tube 210. The mixture is ignited in a porous ceramic burner 212. The burner is housed in a radiation shield 214 which is made from 29-4C stainless steel.

The hot products of combustion pass from the burner in a tube 216 which spirals outward and upward inside housing 208. The products of combustion are cooled by the refrigerant which surrounds tube 216 inside the housing. The cooled products of combustion exit the heater through a stack 218.

Liquid refrigerant in the power circuit enters housing 208 at the bottom of the heater through conduit 70. The refrigerant is heated by contact with the outside of tube 216 and vaporizes at an interface shown schematically at 220. The vaporized refrigerant then exits the housing through conduit 18.

Heater 16 is a high efficiency unit that effectively transfers the heat of combustion of the natural gas to the refrigerant material. It also produces little pollution, including less than 20 parts per million of NOX.

Of course while natural gas is used in the preferred form of the system of the present invention as a fuel source for the heater, in other embodiments other hydrocarbon fuels may be used.

Figure 11:
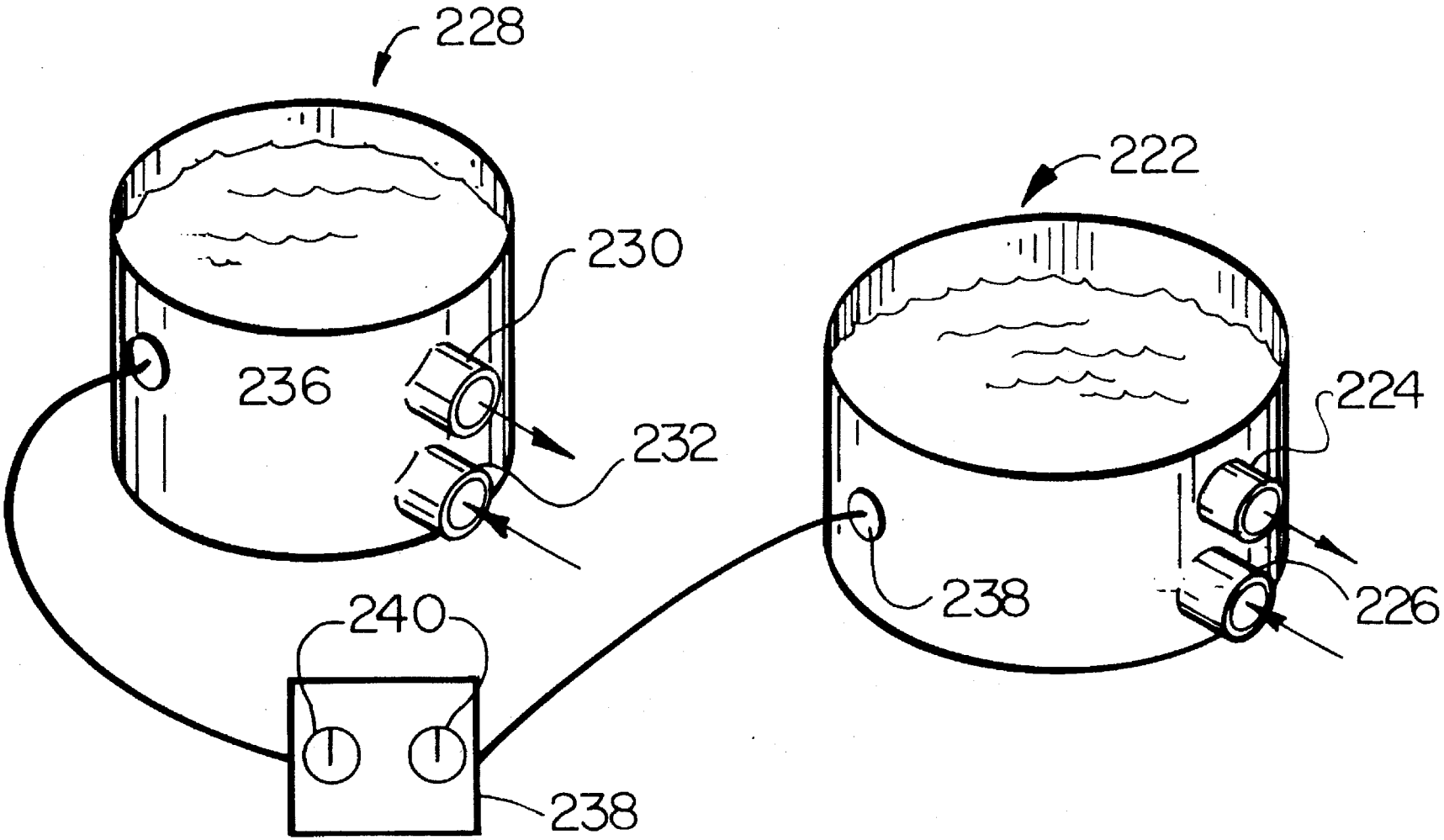
FIG. 11 is a schematic view of a pool, a spa and a temperature controller for controlling the temperature of the water in the pool and spa.

A system for controlling the operation of the high efficiency pool heating system is described with reference to FIGS. 11 and 12. FIG. 11 shows a pool 222 and the water therein. Ducts 224 and 226 for delivering and receiving water from the system respectively, are shown schematically on the side of the pool. A spa 228 and the water therein is also shown. Spa 228 also has ducts 230, 232 for delivering and receiving water from the pool heating system of the present invention, respectively.

A temperature sensor 234 is positioned in the water of the pool to sense its temperature. It will be understood by those skilled in the art that the sensor 234 need not be in the pool but may be conventionally mounted in the water ducts. Likewise spa 228 has a temperature sensor 236 for sensing the temperature of the water therein.

Sensors 234 and 236 are electrically connected to a controller 238. Controller 238 includes inputs (shown schematically as dials 240 and 242) for setting the desired temperature of the water in the spa and pool respectively.

Figure 12:
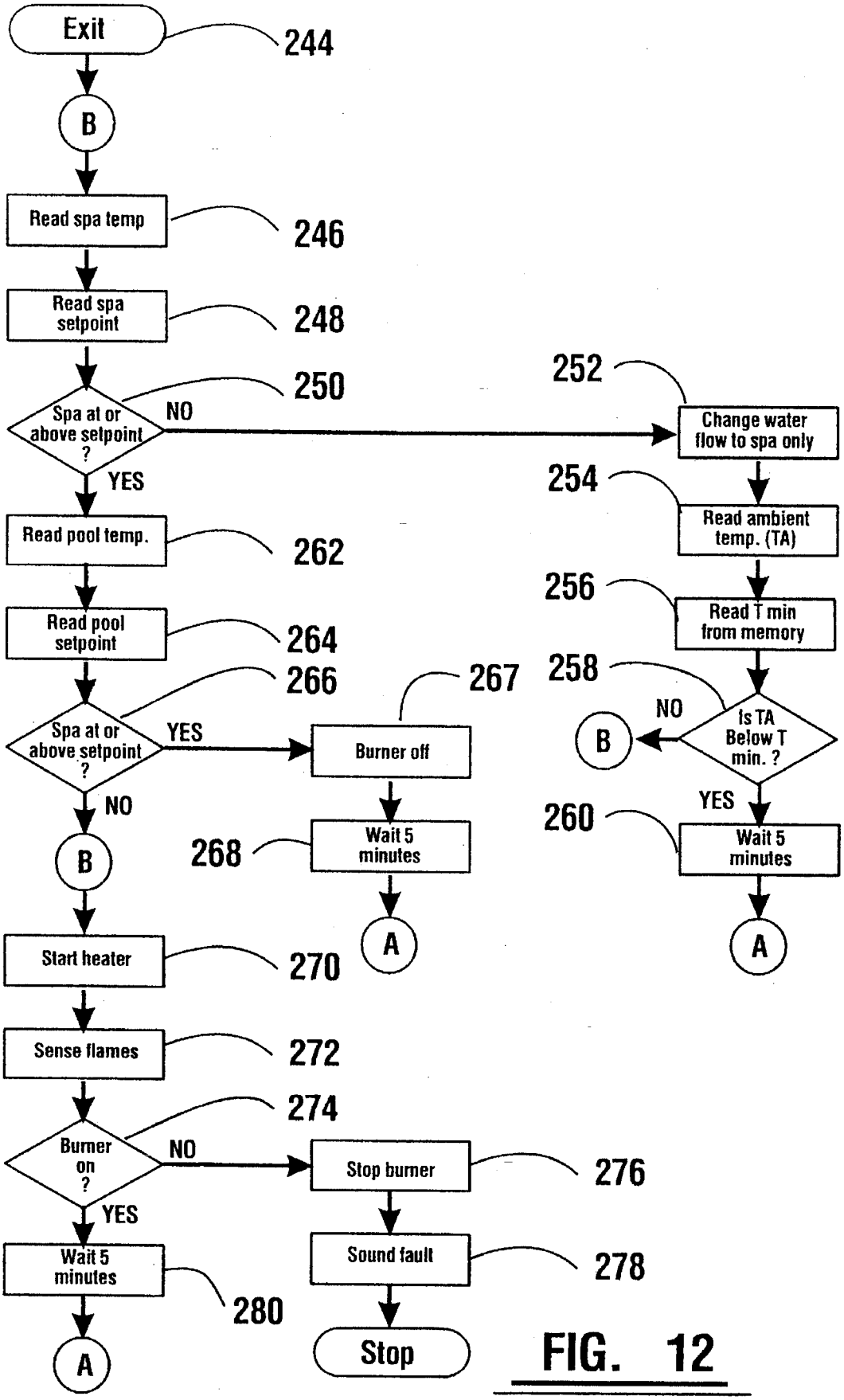
FIG. 12 is a flowchart for a computer program executed by the temperature controller of the preferred embodiment for control of the high efficiency pool heater system of the present invention.
Figure 14:
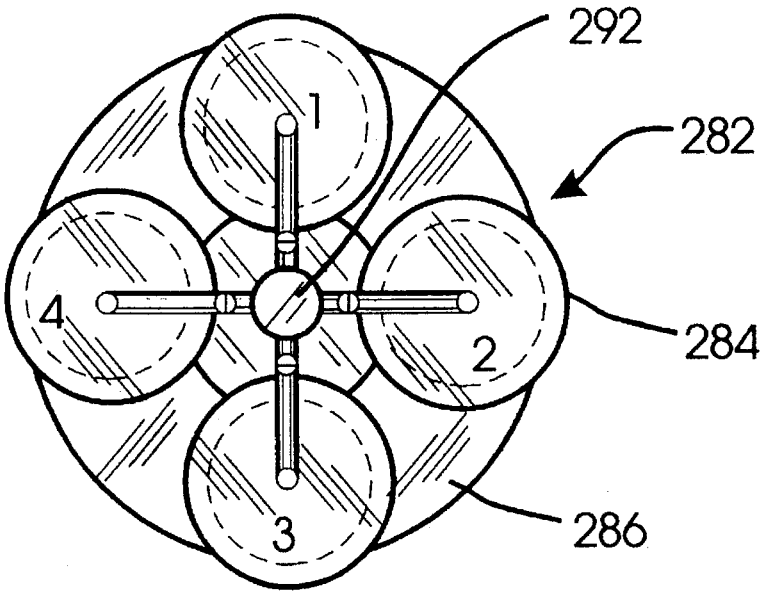
FIG. 14 is a top view of the power unit shown in FIG. 13.

Controller 238 includes a processor and a memory that execute the program steps shown in FIG. 12. From a start point 244 the processor reads the spa temperature from sensor 236 at a step 246. Thereafter, the processor reads the desired temperature of the spa input by the operator, at a step 248. At a decision step 250, the processor compares the temperatures and decides if the spa is at or above the temperature set by the operator.

In accordance with the system of the present invention, the spa is given preference in heating as it holds less water and is likely to be used year round. If the spa is not at the desired temperature, the processor executes a step 252 which changes the system water piping so that only the spa receives water from the system and no heated water is directed to the pool. This step changes the condition of three-way valve 94 so that all the heated water is directed to the spa. Of course as will be understood by those skilled in the art, at the time that the condition of three-way valve 94 is changed, further valving (not shown) is also changed so that water being supplied to the system for heating is taken only from the spa.

Thereafter, the controller executes a step 254 in which it reads the ambient air temperature from a sensor (not shown) in connection with controller 238. This sensor gives the temperature of the ambient air which can be passed through evaporator 102. For purposes of convenience, the ambient temperature is designated "Ta". Of course if the ambient air temperature is too low, the heat pump circuit is not effective. The temperature in which the heat pump is not effective is stored in the controller's memory as "Tmin". At step 256 the processor reads "Tmin" and at step 258 compares the ambient temperature "Ta" to "Tmin".

If the ambient temperature is not too low for effective use of the heat pump circuit, the power and heat pump circuits are controlled as later described. However if the temperature is too low for effective use of the heat pump circuit, the heat pump circuit is disabled at a step 260. This is done by having the processor change the condition of three-way valve 20 so that the working fluid in the power circuit is directed away from power unit 26 and into heat exchanger 72. Heat exchanger 72 heats the water in the spa directly with the working fluid in the power circuit. After changing the condition of three-way valve 20 the controller operates in a manner later described.

In the alternative, if at step 250 the spa is at or above the desired temperature the processor goes on to read the pool temperature from sensor 234 at step 262. The setpoint temperature for the pool set by the operator is read at step 264 and a comparison made at step 266. If the pool is at or above the set temperature, the processor shuts off the heater at step 267 (if the heater is on) and the processor waits five minutes at step 268. The sequence is then repeated to conduct a later test of the water temperatures.

If the pool is not at the set temperature at step 266 (or "Ta" is not below "Tmin" at step 258, or after step 260 has been executed) the processor starts heater 16 at step 270. This actually involves starting the air blower, opening the flow of natural gas and lighting the mixture using an electric starter, all of which operations are well known in the prior art.

In the event of a malfunction, the heater may not light. A flame detector (not shown) is mounted inside the heater. The flame detector provides an electrical indication to the processor of whether a flame is present in the heater. At step 272 the processor checks the signal from the flame detector. At a step 274 the processor then decides if a flame is present. If the heater has failed to light properly, the heater is shut off and a fault alarm sounded at steps 276 and 278 respectively. If the heater is running properly the processor waits five minutes at a step 280. After the heating process has been allowed to proceed for five minutes the processor again runs through the sequence to check the temperatures.

Although not shown in the drawings, it will be understood by those skilled in the art that water pumps are used for moving the water from the pool and the spa through the heat exchangers of the high efficiency pool heating system of the present invention. Likewise those skilled in the art will understand that the system of the present invention also uses conventional valving to direct the water from the impoundments to the heat exchangers to achieve the flows described herein.

Figure 18:
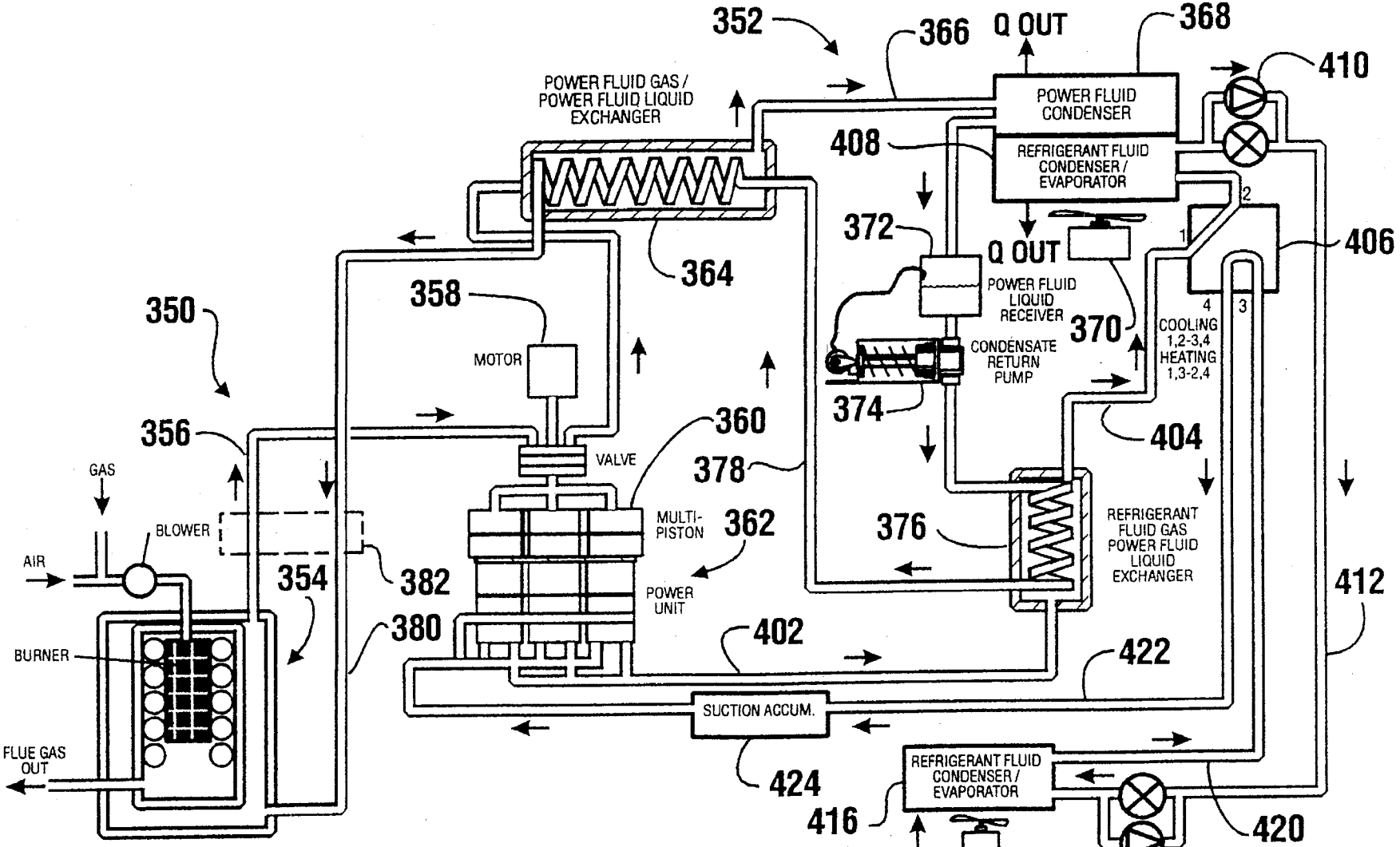
FIG. 18 is a schematic view of an alternative embodiment of a reversible heat pump system in a first operating mode for cooling a selected space.
Figure 19:
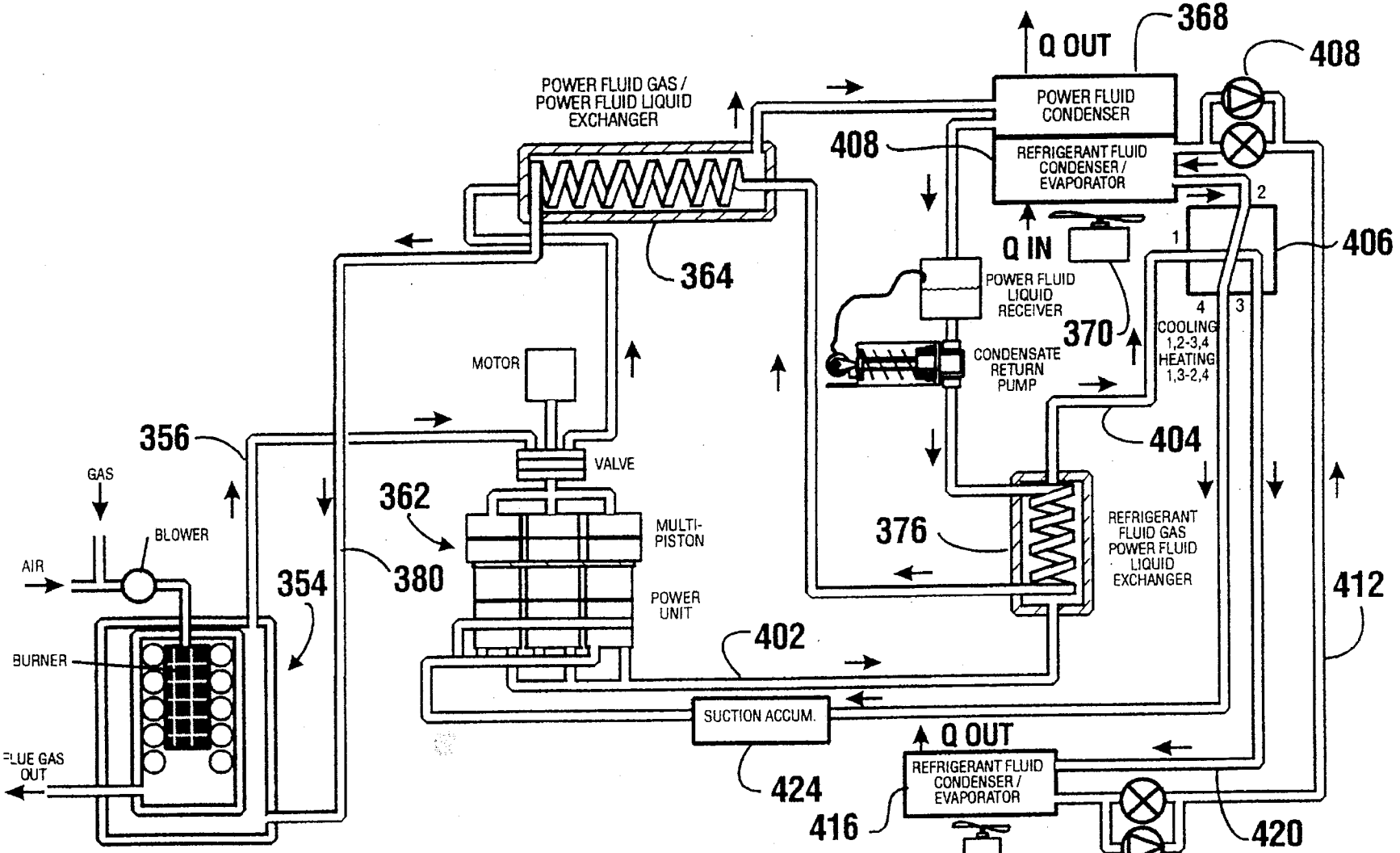
FIG. 19 is a schematic view of the system shown in FIG. 18 in an alternative operating mode for heating the selected space.
Figure 20:
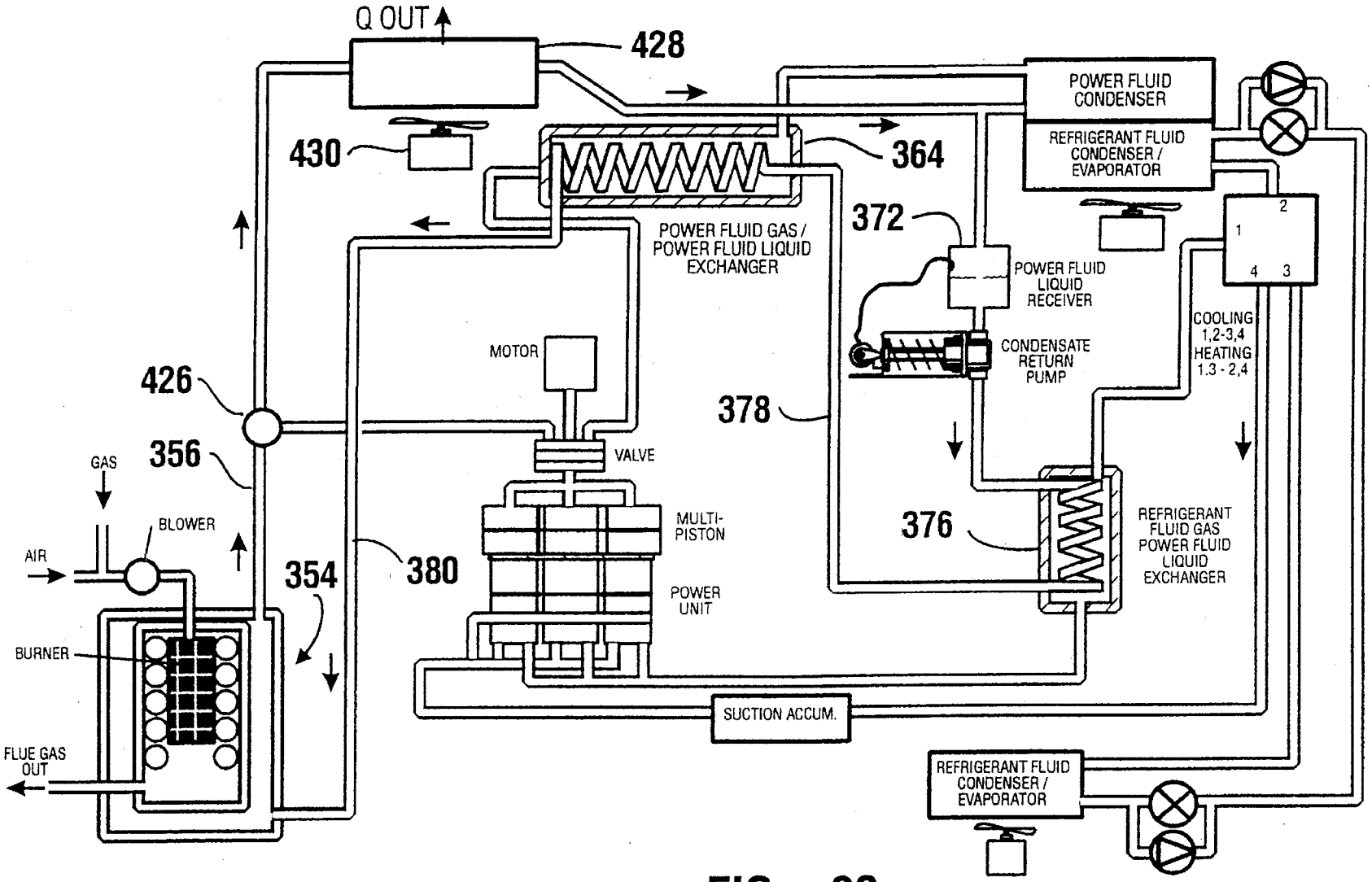
FIG. 20 is a schematic view of an alternative embodiment of the system shown in FIG. 20 for heating a selected space.

An alternative embodiment of the system of the present invention is shown in FIGS. 18–20. The system shown in FIG. 20 has a power circuit 350 and a heat pump circuit 352. The power circuit includes a heater 354 which is similar to heater 16. Heater 354 delivers vaporized first working fluid in a line 356 to a rotary valve assembly 358. Rotary valve assembly 358 is similar to rotary valve assembly 292. Rotary valve assembly 358 delivers the first working fluid to the power modules 360 of power unit 362. The power unit 362 is similar to power unit 282. However the number of power modules in the power unit and the rotary valve assembly may be changed to satisfy the flow requirements of the system.

The first working fluid exhausted from the power unit is passed through a first heat exchanger 364 in which it gives up heat to first working fluid passing back to heater 354. From heat exchanger 364 the fluid passes through a line 366 to a power fluid condenser 368. The fluid gives up heat in the power fluid condenser 368 and condenses to a liquid. The power fluid condenser is preferably air cooled and the heat transfer therefrom is aided by a blower 370. The blower 370 and power fluid condenser are preferably located on the exterior of a building or other space whose temperature is controlled.

The first working fluid passes from the power fluid condenser 368 through a line to a liquid receiver 372. Receiver 372 has a float switch therein (not separately shown). The float switch operates a condensate return pump 374. The float switch is operable to turn on the pump when sufficient liquid is present in the receiver 372, and to turn it off when the liquid is depleted. As later explained, pump 374 is a special diaphragm pump that efficiently pumps the condensed refrigerant, avoids leakage and prevents the liquid from flashing to vapor.

From pump 374 the first working fluid passes through a second heat exchanger 376. In the second heat exchanger the liquid first working fluid gains heat from the second working fluid in the power circuit. The liquid then passes through line 378 and through the opposite portion of heat exchanger 364 in which it gains more heat. Thereafter the liquid passes in line 380 back to the heater 354. Alternatively, a further heat exchanger 382 shown in phantom may be provided between line 380 and line 356 for further preheating of the liquid first working fluid before it returns to heater 354.

Figure 21:
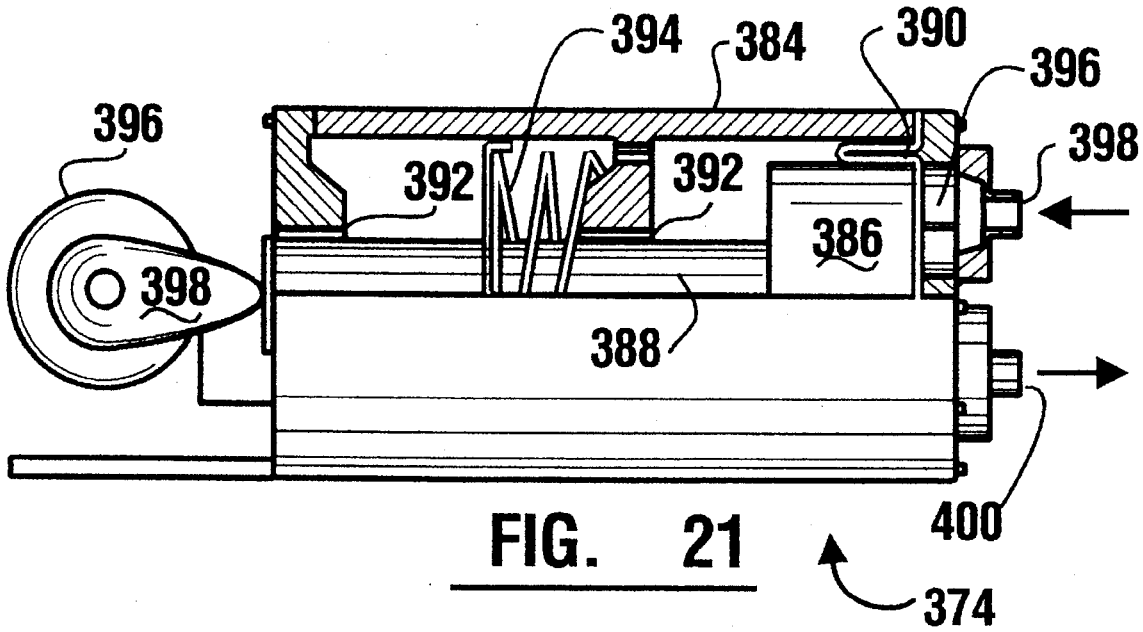
FIG. 21 is a cross-sectional side view of a condensate pump used in the systems of the invention.
Figure 22:
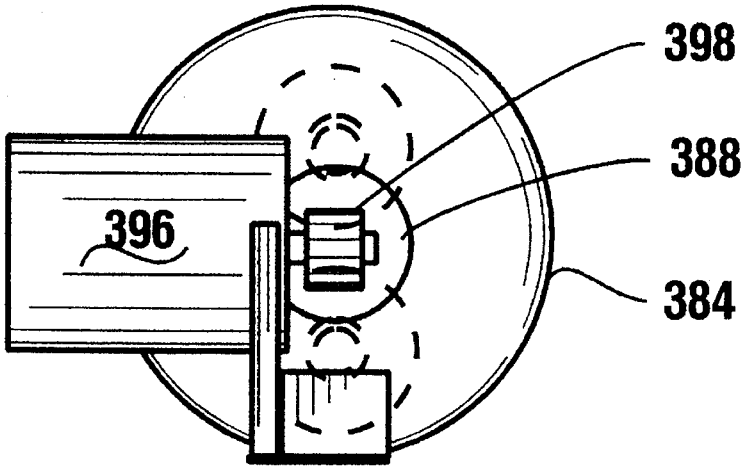
FIG. 22 is an end view of the condensate pump shown in FIG. 21.

Condensate pump 374 is shown in greater detail in FIGS. 21 and 22. Pump 374 has a body 384. A piston 386 is movably mounted in a chamber inside body 384. The piston is connected to a rod 388. Piston 386 supports a rolling diaphragm 390. The rod is supported on plastic PTFE bushings 392 which minimize friction. A spring 344 biases rod 388 to the left as shown in FIG. 21.

An electric motor 396 drives a cam 378 which moves rod 388 in reciprocating motion is shown by the phantom position of rod 388 in FIG. 21. As piston 386 reciprocates the rolling diaphragm 390 moves in supported relation thereon. This alternatively increases and decreases the volume of a pumping chamber 396. Pump body 384 has an inlet 398 and an outlet 400 in communication with chamber 396. Inlet 398 has a flapper type check valve of the type previously described adjacent thereto to permit one way flow therethrough into the chamber 396. Likewise a similar check valve adjacent outlet 400 permits flow out of chamber 396.

The rolling diaphragm pump enables the first working fluid returning to the heater to overcome the pressure therein. The rolling diaphragm further provides an even pressure distribution on the liquid. This avoids creating pockets of reduced pressure which would cause the liquid to flash to a gas which would impede or prevent pumping. Such flashing would occur with other types of pumps. In addition the pump minimizes the risk of leakage and has low frictional losses. This further saves energy and protects the environment.

Referring again to FIG. 18 the heat pump circuit 352 has a second working fluid flowing therein the vapor phase of which is compressed by power unit 362. The compressed vapor passes in a line 402 to heat exchanger 376 where it gives up heat to the first working fluid. The vapor then passes in a line 404 to a four way control valve 406. In the position of 4 way valve 406 shown in FIG. 18 the vapor is passed to an exterior coil 408 which is a heat exchanger located outside the space whose temperature is being controlled by the system. In the condition shown in FIG. 18, coil 408 serves a condenser and gives up heat. Preferably, coil 408 is mounted adjacent to power fluid condenser 368 and blower 370 serves to pass air through both for facilitating heat transfer to the atmosphere.

In coil 408 the second working fluid condenses to a liquid. The liquid passes out of the coil 408 and through a combination orifice and check valve assembly 410 which includes an orifice and check valve mounted in parallel.

The check valve in assembly 410 is arranged so that liquid can flow freely through the check valve portion out of the coil. The liquid then passes through a line 412 and into the space whose temperature is controlled by the system.

The liquid second working fluid then passes through another orifice and check valve assembly 414. The check valve in assembly 414 is arranged to block flow in the direction shown. As a result, the refrigerant is required to flow through the orifice of the assembly which serves to expand the refrigerant. Of course, in other embodiments capillary tubes or other types of expansion devices may be used.

The expanded second working fluid then passes through an interior coil 416. The working fluid absorbs heat from the surrounding air and evaporates. A blower 418 passes air through coil 416 to facilitate the heat transfer to the second working fluid. The second working fluid then vaporizes in coil 416 and is passed through a line 420 and back through the 4 way valve 406. The fluid then travels through a line 422 back to the power unit. A suction accumulator 424 is positioned in line 422 to prevent any liquid working fluid from reaching the power unit 362.

The system shown in FIG. 18 operates to efficiently cool the area of the interior coil 416. It has been found that this system has a high coefficient of performance relative to the prior art.

Heating of the area where the interior coil 416 is positioned is accomplished by changing the condition of 4 way valve 406 to the condition shown in FIG. 19. Vaporized second working fluid passes through the 4 way control valve 406 and into line 420. It then passes to interior coil 416 where it gives up heat and condenses to a liquid. This heats the area in which the temperature is controlled.

The now liquid second working fluid passes freely through the check valve of assembly 414 and into line 412. The liquid working fluid is required to pass through the orifice of assembly 410. The refrigerant expands in exterior coil 408 and gains heat from both the atmosphere and condenser 368. The air direction of blower 370 is controlled to maximize the heat recovery.

The now vaporized second working fluid leaves the exterior coil 408, passes through the four-way valve 406 and into line 422 for return to the power unit. In the heating mode the system has an even higher coefficient of performance.

In some ambient air conditions it is too cold for the system to provide efficient heating. The alternative system shown in FIG. 20 is suitable in these circumstances. The system shown in FIG. 20 is identical to the systems of FIGS. 18 and 19 except a three-way valve 426 is provided in line 356. Valve 426 is operative to direct the heated first working fluid to a bypass heat exchanger 428 in the area to be heated. The power unit is completely by-passed. A blower 420 is provided to facilitate heat transfer. The working fluid condenses in the by-pass exchanger and passes back to the receiver 372. From there the first working fluid returns to the heater 354 in the manner previously discussed.

Applicant has also found it useful in some systems to place diaphragm pumps similar to pump 374 in series with the orifices as part of assemblies 410 and 412. The pumps are located upstream on the liquid side and are by-passed during flow through the check valve in the opposite direction. The pumps serve to increase the pressure before the expansion orifice. This further increases efficiency.

Figure 23:
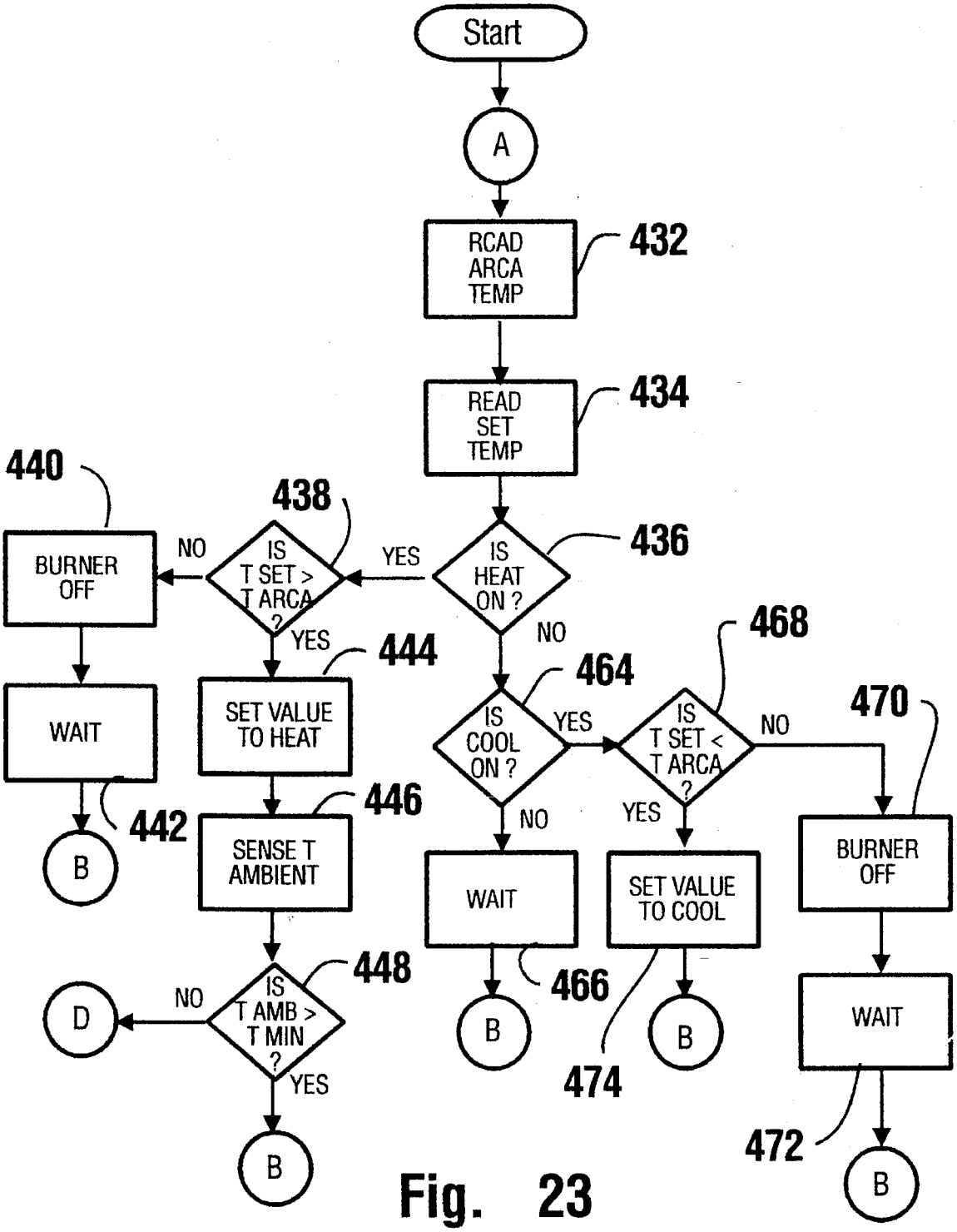
FIGS. 23 through 25 are a flow chart for operation of the system shown in FIG. 20.
Figure 24:
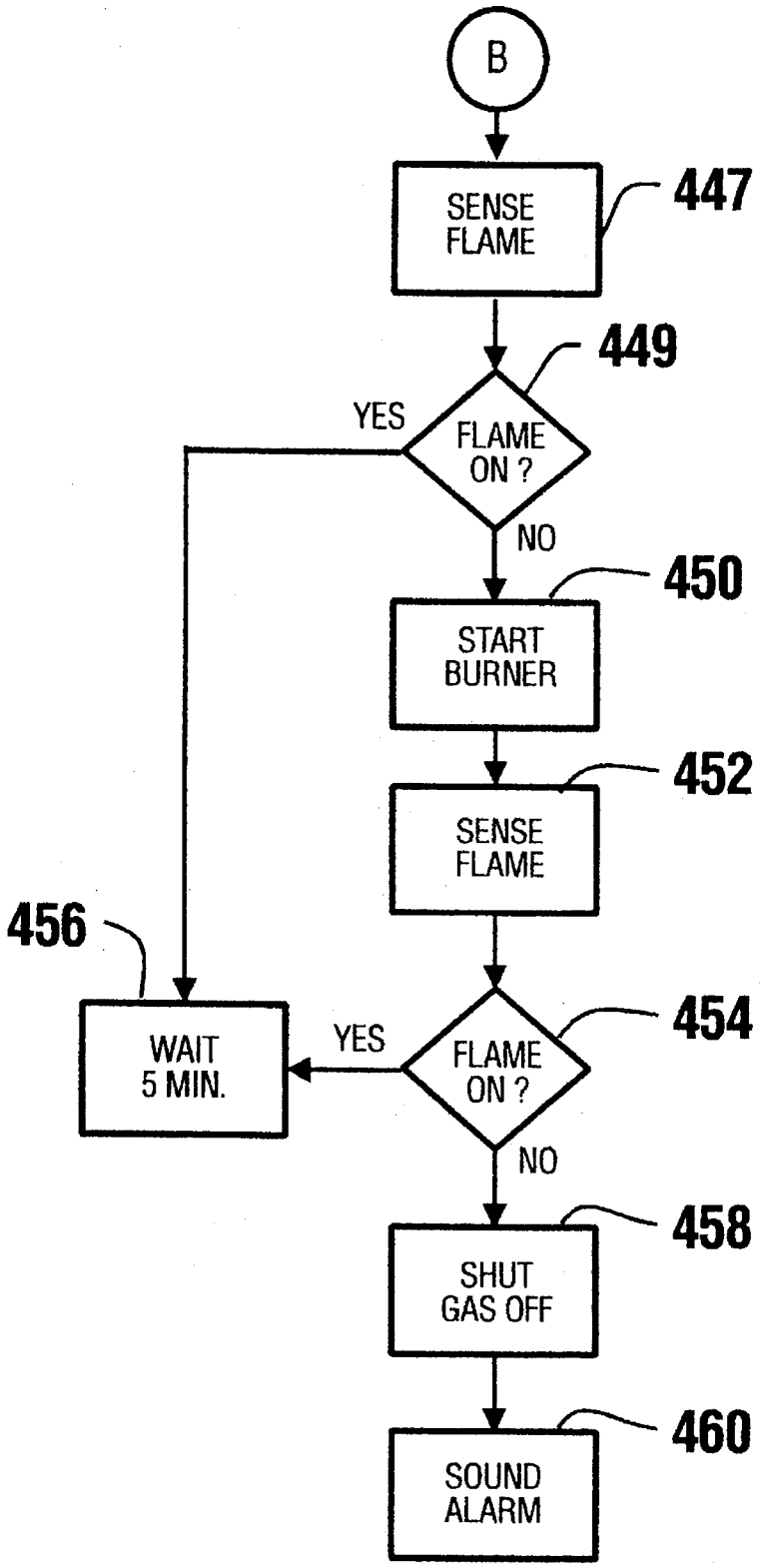
Figure 25:
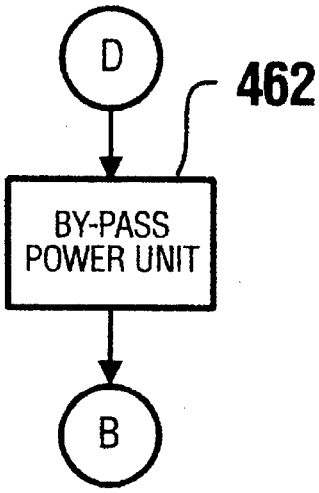

The system shown in FIG. 20 is controlled by a thermostatic controller having a processor and a memory for controlling the temperature in the space being controlled. The program extended by the processor is shown schematically in FIGS. 23–25.

The controller has a sensor that senses the inside temperature of the area being controlled. This temperature is sensed at a step 432. The desired temperature set at the controller is checked at a step 434.

The controller is set to either "heat, " "cool" or "off." A check for the heat setting is done at decision step 436. If the controller is set to heat, a comparison is made to the set and area temperatures at step 438. If the area temperature is greater than the set temperature, the burner is shut off at a step 440. The system then waits for a period of time which is preset at a step 442. The wait is generally fixed at from 1 to 5 minutes and then the program restarts.

If at step 438 the set temperature is above the area temperature, the four-way valve 406 is moved to provide heat at interior coil 416 at a step 444. The system then reads the ambient temperature adjacent exterior coil 408 using a sensor adjacent thereto at a step 446. The system then decides at a step 448 if the ambient temperature is greater than a minimum stored in memory below which the system will not work efficiently.

If the temperature is above the minimum, the system checks to see if the flame is lit and the burner is on at steps 447 and 449. If not, the burner is started at a step 450. This is done by starting the flow of natural gas and triggering an electric starter. A flame sensor then looks for the flame at a step 452. A check is made for a proper start at a step 454. If the burner is running properly, the system is run for five minutes at a step 456 and then another temperature check is made. If the burner is not sensed to have lit, the gas is shut off at a step 458. An alarm is triggered at a step 460 and the system shut down.

If the ambient temperature is below the set minimum at step 448, valve 426 is moved at a step 462 to by-pass the power unit. The burner is then started in the conventional manner previously discussed.

If the controller is not set to heat in step 436, a check is made to see if it is set to cool at a step 464. If not, the system waits a preset period at a step 466 and then starts again.

If the unit is set to cool, the controller tests to see if the controller is set to a temperature below the area temperature at a step 468. If not, the burner is shut off at a step 470 and the system waits at step 472 the preset period. If the set temperature is below the area temperature, the system sets four-way valve 406 so that heat is absorbed at interior coil 416. This is done at step 474. The burner then starts and the system runs in the manner previously discussed.

The system of the present invention has a high coefficient of performance for both heating and cooling. It is reliable and economical.

Although the embodiments of the present invention use R-22 refrigerant as a working fluid in the both the power and heat pump circuits, in other embodiments different working fluids may be used. The present invention is also particularly adapted for use with the new non-polluting refrigerant materials. The heat pump circuit may employ a different fluid than the power circuit.

Thus, the new high efficiency heat pump system of the present invention achieves the above stated objectives, eliminates difficulties encountered in the use of prior devices and systems, solves problems and obtains the desirable results described herein.

In the foregoing description certain terms have been used for brevity, clarity and understanding, however no unnecessary limitations are to be implied therefrom because such terms are for descriptive purposes and are intended to be broadly construed. Moreover, the descriptions and illustrations are by way of examples and the invention is not limited to the details shown and described.

Having described the features, discoveries and principles of the invention, the manner in which it is constructed and operated and the advantages and useful results obtained, the new and useful structures, devices, elements, arrangements, parts, combinations, systems, equipment, operations and relationships are set forth in the appended claims.

I claim:

1. A high efficiency gas fired heat pump system comprising:

a power circuit including a gas fired heater heating and vaporizing a first working fluid;

a power unit having a first chamber, said first chamber having a driving piston movably mounted therein;

a valve for selectively delivering and exhausting first working fluid from the first chamber of the power unit wherein said driving piston undergoes movement responsive to said delivery and exhaust of first working fluid;

a first condenser in connection with said valve for receiving first working fluid exhausted from the first chamber, the first condenser in fluid communication with the gas fired heater wherein condensed first working fluid is returned thereto;

a heat pump circuit including:

a second chamber in the power unit; the second chamber having a second piston therein in driven operative connection with the first piston wherein a second working fluid is compressed in the second chamber;

an exterior coil having a first expansion device in connection therewith; an interior coil having a second expansion device in connection therewith; and a control valve for selectively directing the compressed second working fluid from the power unit to one of either the interior or exterior coil for condensation therein and directing said condensed second working fluid to said other of said coils through the expansion device in connection therewith, wherein said other coil returns vaporized second working fluid to the second chamber of the power unit.

2. The system according to claim 1 and further comprising:

a by-pass heat exchanger; and a by-pass valve for selectively directing first working fluid from said gas fired heater to said by-pass heat exchanger in lieu of said power unit.

3. The system according to claim 2 and further comprising a controller in operative connection with said by-pass valve, and a temperature sensor in connection with the controller, wherein the controller controls the position of the by-pass valve responsive to temperature.

4. The system according to claim 1 and further comprising a controller, and a flame sensor in connection with said gas fired heater and the controller, and a gas valve selectively delivering gas to said heater, said gas valve in connection with said controller, wherein said controller closes flow through said gas valve responsive to non-detection of flame by the flame sensor.

5. The system according to claim 4 and further comprising an electric starter in connection with said gas fired heater and said controller, wherein said controller actuates said electric starter to light said heater.

6. The system according to claim 1 wherein said valve comprises:

a rotatable valve element having at least one fluid passage therethrough, said valve element including opposed facing surfaces;

a pair of abutting surfaces, said valve element positioned thereinbetween and abutting said facing surfaces;

a first one of said abutting surfaces including a first fluid opening receiving first working fluid from the heater, and a second one of said abutting surfaces having a second fluid opening to said first chamber, said first and second fluid openings in fluid communication through said first valve element when said element is in a first rotational position; and a motor in driving connection with said valve element, wherein said motor selectively rotatably moves said valve element to place said first and second fluid openings in communication, whereby first working fluid is delivered to said first chamber.

7. The system according to claim 1 wherein a first rolling diaphragm is supported on said driving piston and a second rolling diaphragm is supported on said second piston.

* * * * *